United States Patent [19]

Suzuki et al.

[11] 4,453,834

[45] Jun. 12, 1984

[54] ELECTRONIC TIMEPIECE WITH TEMPERATURE COMPENSATION

[75] Inventors: Fuminori Suzuki; Makoto Yoshida; Shigeru Morokawa, all of Tanashi, Japan

[73] Assignee: Citizen Watch Company Limited, Tokyo, Japan

[21] Appl. No.: 394,198

[22] Filed: Jul. 1, 1982

[30] Foreign Application Priority Data

Jul. 3, 1981 [JP] Japan ..... 56-104228
Jul. 7, 1981 [JP] Japan ..... 56-105903

[51] Int. Cl.[3] ..... G04B 17/12
[52] U.S. Cl. ..... 368/201; 368/202
[58] Field of Search ..... 368/200, 202, 201

[56] References Cited

U.S. PATENT DOCUMENTS

| | | | |
|---|---|---|---|
| 4,148,184 | 4/1979 | Akahane et al. | 368/201 |
| 4,272,840 | 6/1981 | Morozumi | 368/200 |
| 4,298,971 | 11/1981 | Morokawa et al. | 368/202 |
| 4,321,698 | 3/1982 | Gomi et al. | 368/200 |

*Primary Examiner*—Bernard Roskoski
*Attorney, Agent, or Firm*—Jordan and Hamburg

[57] ABSTRACT

An electronic timepiece having a quartz crystal oscillator circuit as a timebase signal source is provided with a temperature compensation system to compensate timebase signal frequency deviations with temperature, all components of the system being incorporated in the timepiece IC chip. The system is based on a temperature-sensitive voltage stabilizer circuit whose output voltage is current-converted to control the frequency of a temperature-insensitive oscillator circuit. Date generated on the basis of the latter oscillator frequency is applied to compensate the timebase signal frequency, by a capacitor switching technique.

11 Claims, 29 Drawing Figures

ELECTRONIC TIMEPIECE WITH TEMPERATURE COMPENSATION

BACKGROUND OF THE INVENTION

In order to provide a high level of timekeeping accuracy in an electronic timepiece utilizing a quartz crystal vibrator controlled oscillator circuit as a timebase signal source, it is necessary to provide means for compensating the deviations which occur in the timebase signal frequency due to the effects of ambient operating temperature variations upon the quartz crystal vibrator. Various temperature compensation systems for this purpose have been proposed in the prior art, but none of these systems has been widely adopted on a practical basis. This is due to the fact that almost all of such prior art systems are based upon the use of a pair of quartz crystal vibrators, or a temperature-sensing component such as a thermistor which is mounted external to the timepiece IC chip. Thus, such a system will increase the manufacturing cost of the timepiece, and in addition they generally have the considerable disadvantage that individual adustment of the system to provide optimum temperature compensation must be performed for each individual timepiece, and that such adjustment is usually not suited to automated manufacturing methods.

SUMMARY OF THE INVENTION

The present invention overcomes the disadvantages of such prior art temperature compensation systems, and provides a very high accuracy of compensation, hitherto attainable only with expensive timepieces, yet is eminently suited to automated mass-production timepiece manufacture and does not require the addtion of external components to the timepiece. In addition, a temperature compensation system according to the present invention is highly suited to automatic adjustment for optimum compensation operation. A temperature compensation system according to the present invention is based upon a temperature-sensing voltage stabilizer circuit which generates an output voltage which varies linearly with temperature and which is virtually unaffected by changes in the timepiece battery voltage. This output voltage is arranged to control the operating current of an current-sensing oscillator circuit (which is a ring oscillator circuit in the embodiment described in the specification) such that the frequency of oscillation of the latter oscillator circuit varies linearly with temperature. Changes in the latter frequency of oscillation are converted into digital data, whose value varies linearly with temperature, and means are provided whereby the slope and offset of the temperature characteristic of the latter data can be adjusted to provide optimum compensation. This temperature data value is utilized to frequency compensation, after having been squared (due to the quadratic temperature characteristic of the quartz crystal oscillator circuit). This frequency compensation operation can be implemented in various ways, either by directly controlling the frequency of operation of the quartz crystal oscillator circuit, as in the preferred embodiments described hereinafter, or by controlling the effective frequency division ratio of the frequency divider circuit which receives the timebase signal. In the preferred embodiments, this frequency correction is carried out by switching of capacitors coupled to the quartz crystal oscillator circuit, to cause alternate operation at two slightly different frequencies of oscillation, with the temperature data value described above serving to control the duty cycle of this switching. In order to minimize power consumption, temperature measurement to derive this temperature data value is performed on an intermittent periodic basis, with the values thus produced being stored in a data register.

DETAILED DESCRIPTION OF THE INVENTION

Figure 1:
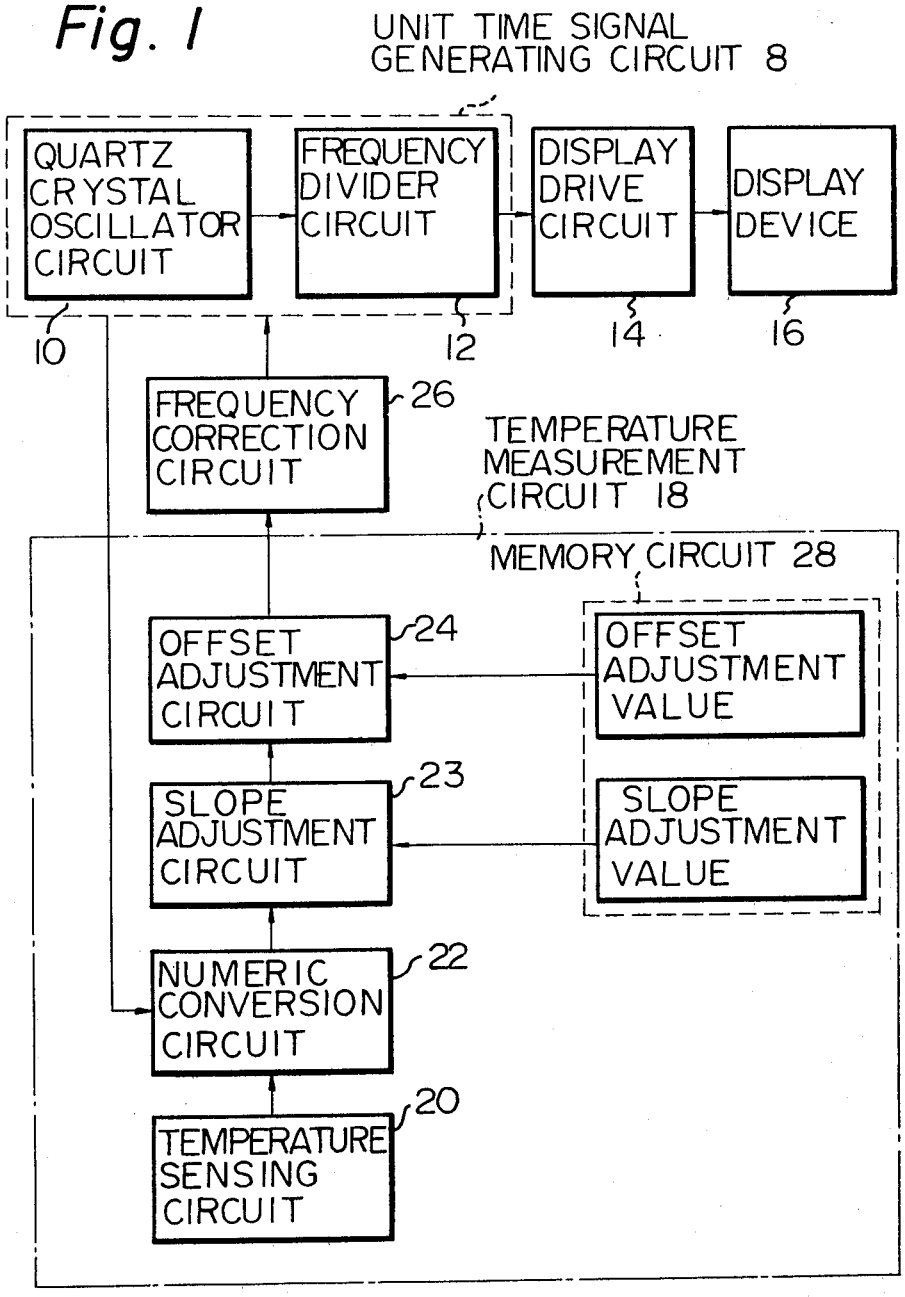
FIG. 1, FIG. 3, FIG. 4 are block circuit diagrams showing the basic configurations of embodiments of electronic timepieces according to the present invention.
Figure 2A:
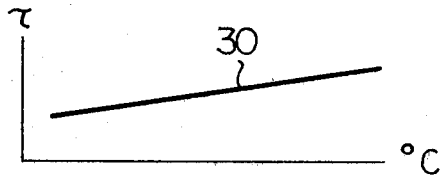
FIGS. 2(*a*)–2(*d*), FIGS. 5(*a*) and 5(*b*), FIG. 9, FIGS. 12(*a*)–12(*c*), FIGS. 13(*a*)–13(*c*), FIGS. 15(*a*) and 15(*b*) and FIGS. 17(*a*) and 17(*b*) are temperature characteristic diagrams to illustrate the operation of embodiments of electronic timepieces according to the present invention.
Figure 2B:
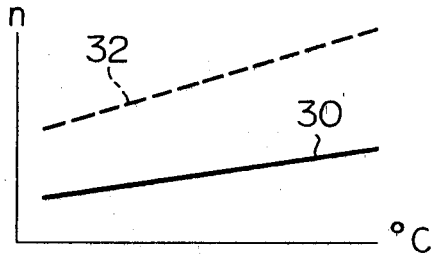
Figure 2C:
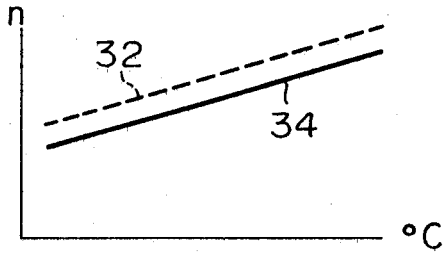
Figure 2D:
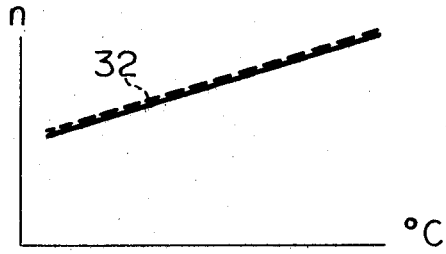

FIG. 1 is a block diagram showing the basic configuration of an electronic timepiece provided with temperature compensation in accordance with the present invention. A unit time signal generating circuit section 8 serves to generate a unit time signal, and comprises a quartz crystal oscillator circuit for producing a timebase signal, this timebase signal frequency displaying a quadratic temperature characteristic, and a frequency divider circuit 12 for frequency dividing the timebase signal to generate a plurality of signals of different frequencies including the unit time signal. A display drive circuit 14 receives the unit time signal and drives an analog or digital display device 16 to provide a time indication. Numeral 18 denotes a temperature measurement circuit which serves to sense the operating temperature of the timepiece and to produce digital data which varies in a predetermined manner (i.e. either linearly or as a quadratic function) with respect to temperature. This data is input to a frequency correction circuit 26, which acts on unit time signals generating circuit 8, i.e. by modification of the frequency of oscillation of quartz crystal oscillator circuit 10 or modification of the effective frequency division ratio of frequency divider circuit 12 to compensate for the effects of temperature variations on the frequency of the unit time signal, this correction being implemented such that a high degree of timekeeping accuracy is provided by the timekeeping signals produced from frequency divider circuit 12.

The temperature measurement circuit 18 has the following configuration. A temperature sensing circuit 20 produces an output signal having a frequency which varies linearly with changes in timepiece operating temperature (i.e. temperature as measured adjacent to the quartz crystal vibrator). This output signal is input to a numeric conversion circuit 22, which performs conversion of the frequency of the output signal from temperature sensing circuit 20 into a numeric value, using an output signal from unit time signal generating circuit 8 as a frequency reference. Thus, the numeric value generated by numeric conversion circuit 22 varies linearly with temperature changes. The rate of change of this value with respect to temperature (referred to herein simply as the "slope") is modified by means of a slope adjustment circuit 22, while the absolute level of the temperature data represented by the numeric value can be adjusted by an offset adjustment circuit 23, with logic circuits being used in each case to perform the adjustments. The amount of slope adjustment performed is determined by a numeric value stored in a memory circuit 28, while the amount of offset adjustment is determined by an offset adjustment value stored in memory circuit 28.

In order to perform frequency correction, frequency correction circuit 26 performs computations on the temperature data produced by temperature measurement circuit 18, and utilizes a group of intermediate-frequency signals output from frequency divider circuit 12 in conjunction with the results of the latter computations to generate frequency correction signals, which are applied to correct either the frequency of operation of quartz crystal oscillator circuit 10 or the effective division ratio of frequency divider circuit 12.

Referring now to FIGS. 2(*a*) to (*d*), temperature characteristics are shown for illustrating the sequence of operations by which temperature data is generated by temperature measurement circuit 18. FIG. 2(*a*) shows the temperature characteristic of the period $\tau$ of an output signal from temperature sensing circuit 20 in temperature measurement circuit 18. The temperature characteristic of $\tau$ is linear, as indicated by numeral 30. FIG. 2(*b*) illustrates how the temperature characteristic of $\tau$ is converted into a temperature value which varies linearly with temperature. The broken-line temperature characteristic 32 is the ideal characteristic desired for the temperature data to be output from temperature measurement circuit 18, i.e. the temperature characteristic for that output data which will ensure accurate frequency correction by frequency correction circuit 26. This ideal temperature characteristic 32 depends upon the temperature characteristic of quartz crystal oscillator circuit 10 and the circuit arrangement of frequency correction circuit 26. FIG. 2(*c*) illustrates the condition in which the slope of the temperature characteristic of the numeric data from temperature measurement circuit 18 has been changed from that of FIG. 2(*b*), by the action of slope adjustment circuit 23. The slope of the temperature characteristic of the temperature data value has now been made parallel to that of the desired ideal temperature characteristic. Then, as shown in FIG. 2(*d*), offset adjustment circuit 44 acts to bring the temperature characteristic of the temperature data into coincidence with the ideal temperature characteristic 32.

The above operations to generate temperature data are performed on an intermittent periodic basis, with a comparatively long period of the order of 30 seconds or more. The temperature compensation operations which are carried out by frequency correction circuit 26, on the other hand, are performed continuously. Thus, the temperature data produced by temperature measurement circuit 18 as described above is stored in a temperature register, as described hereinafter, to be continuously available for use by frequency correction circuit 26.

In order to correct for the temperature characteristic of quartz crystal oscillator circuit 10, frequency correction circuit 26 converts the temperature data from temperature measurement circuit 18 to produce data which has a quadratic temperature characteristic, i.e. which varies as a quadratic function of temperature.

Setting of the offsest adjustment value and slope adjustment value stored in memory circuit 28 is performed after manufacture of the timepiece, with these values being set such that the operations shown in FIG. 2 will be accurately performed upon the data value from numeric conversion circuit 22. Memory circuit 28 can comprise a semiconductor memory section whose contents can be altered by input of external signals, or can simply comprise an array of selectable switch contacts disposed external to the timepiece IC chip.

Figure 3:
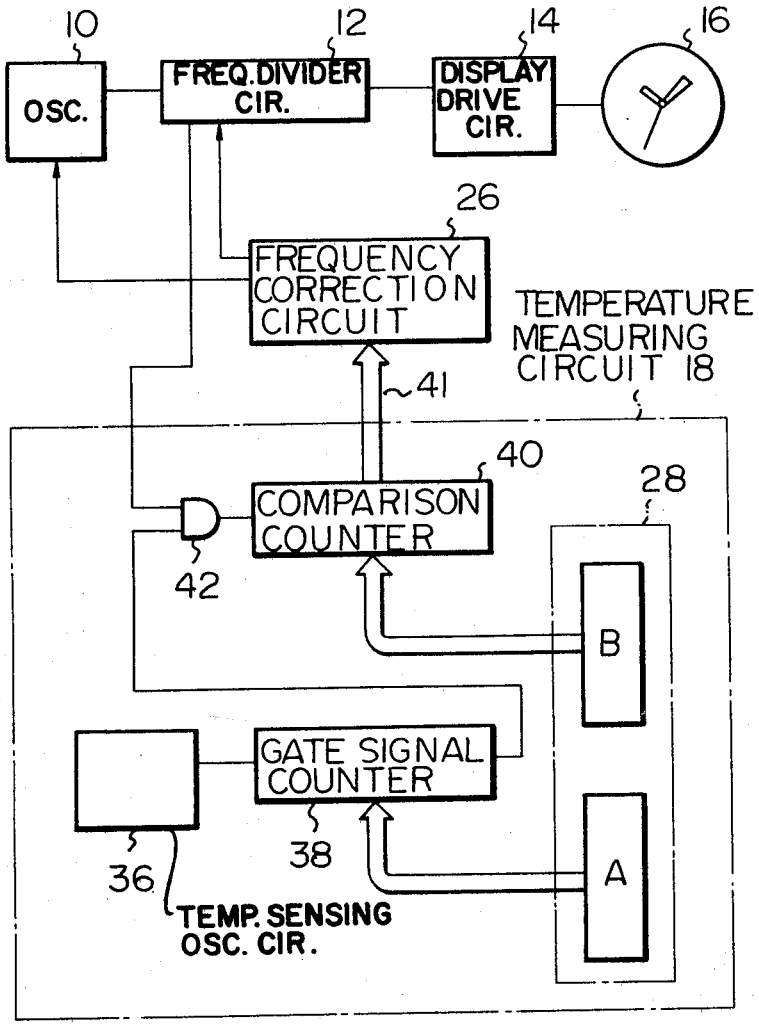

FIG. 3 shows a block circuit diagram of the basic configuration of an electronic timepiece embodiment provided with temperature compensation according to the present invention, which is based on the configuration of FIG. 3. In temperature measurement circuit 18, temperature sensing circuit 20 of the embodiment of FIG. 3 is implemented as a temperature sensing oscillator circuit 36, whose output signal is input to a gate signal counter circuit 8 which serves as slope adjustment means (i.e. as slope adjustment circuit 23 in the embodiment of FIG. 3). Frequency comparison between a clock signal Pc from frequency divider circuit 12, serving as a frequency reference, and the output signal from gate signal counter circuit 38 is performed by a gate circuit 42, which receives these signals as inputs, in conjunction with a comparison counter circuit 40, which is coupled to count pulses of signal Pc under the control of the output signal from gate circuit 42. Gate signal counter circuit 38 counts up to a maximum of A pulses of the temperature sensing signal, and while this is taking place, a gate signal output from the latter circuit enables gate circuit 42 to transfer the clock signal Pc to be counted by comparison counter circuit 40, which counts from an initial value of B up to a predetermined maximum value. The comparison counter circuit 40 performs the functions of both numeric conversion circuit 22 and offset adjustment circuit 24 in the embodiment of FIG. 1, and generates digital data signals 41 which represent temperature as a temperature data value T. Signals 41 are applied to a frequency correction circuit 26. Both comparison counter circuit 40 and gate signal counter circuit 38 are presettable counters, which are preset with an offset adjustment value B and a slope adjustment value A, both stored in a set value memory circuit 28. This will be described in more detail hereinafter.

Figure 4:
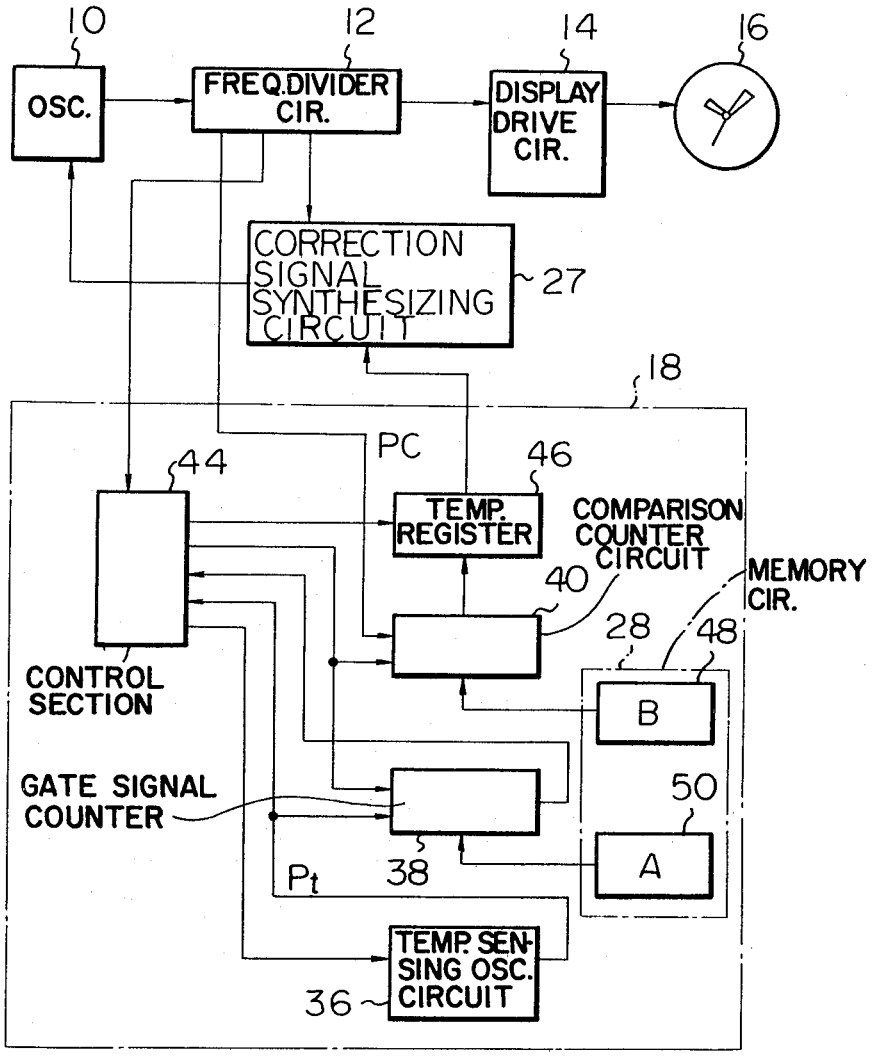

Referring now to FIG. 4, a block circuit diagram is given for describing in greater detail the embodiment of FIG. 3. In FIG. 4, numeral 46 denotes a temperature register which stores a final count value attained by comparison counter circuit 40. A control section 44 performs time-sharing control of the temperature measurement operations. In this example, compensation is performed by direct correction of the operating frequency of quartz crystal oscillator circuit 10, and signals for performing this correction are generated by a correction signal synthesizing circuit 27, which thus performs the functions of frequency correction circuit 26 in FIG. 3. The correction signal synthesizing circuit 27 generates output signals in response to temperature data supplied by temperature measurement circuit 18. The functions of gate circuit 42 can be considered to be performed by control section 44, which operates in synchronism with timing signals supplied from frequency divider circuit 12.

Numeral 50 denotes a first numeric data memory section of memory means 28, which provides a numeric value A (the slope adjustment value) as an initial preset value for gate signal counter circuit 38. Numeral 48 denotes a second numeric data memory section which stores a numeric value B, (the offset adjustment value) used as an initial preset value for comparison counter circuit 40. Both values A and B are externally settable. In this embodiment, it will be assumed that memory means 28 comprises a memory circuit formed integrally in the timepiece intergrated circuit chip, but this can comprise an external contact pattern, as stated above. The temperature compensation operation will now be described. The temperature measurement circuit 18 performs measurement during periodically repeated short time intervals, whose duration is determined by a timer circuit within control section 44, as described in detail hereinafter. When a temperature measurement operation is to begin, the gate signal counter circuit 38 and comparison counter circuit 40 are preset with the values A and B respectively. Next, a temperature sensing signal whose period will be designated as $\tau$ is generated by temperature sensing oscillator circuit 36 and is input to gate signal counter circuit 38. A clock signal Pc, of frequency fc, is input to be counted by comparison counter circuit 40. This signal Pc is supplied from frequency divider circuit 12, and therefore serves as a frequency reference based on the frequency of oscillation of quartz crystal oscillator circuit 10. Thus, comparison counter circuit 40 begins counting from an initial value of B. The gate signal counter circuit 38 simultaneously begins counting the output signal from temperature sensing oscillator circuit 36, and after a number of pulses equal to the value A have been counted by gate signal counter circuit 38 (i.e. after a time of $A\times\tau$ has elapsed), a gate signal produced from counter circuit 38 causes control section 44 to terminate counting by comparison counter circuit 40 and gate signal counter circuit 38. During the interval in which counting is performed, comparison counter circuit 40 will overflow a number of times, and the final count value therein is designated as the temperature data value T. This is transferred to the temperature register 46 and stored therein. The temperature data value T obtained as described above is represented by the following equation:

$$T=A\times\tau\times fc+B-2^P\times m$$

Here, p denotes the number of bits (i.e. binary counter stages) of comparison counter circuit 40, m is the number of times that overflow by comparison counter circuit 40 occurs during counting.

Figure 5A:
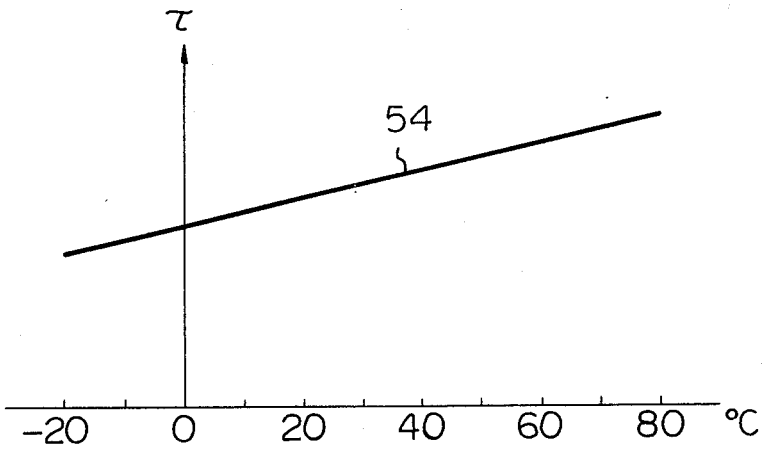
Figure 5B:
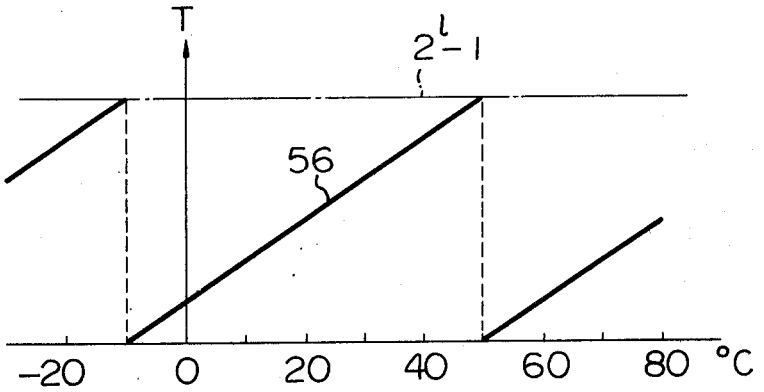

FIG. 5 shows the temperature characteristics of temperature measurement circuit 18. FIG. 5(*a*) shows the temperature characteristic of the period $\tau$ of temperature sensing oscillator circuit 36 with the period $\tau$ being plotted along the vertical axis and temperature along the horizontal axis. FIG. 5(*b*) shows the relationship between temperature and the temperature data value T which is stored in temperature register 46. As shown, the slope of the temperature characteristic of period $\tau$ is virtually constant over the timepiece operating temperature range. It has been found by experiment that with the temperature sensing oscillator circuit used in the present embodiment and described hereinafter, the period $\tau$ at 50° C. is approximately 35% longer that that at 0° C. This relationship is determined by the impurity concentrations in the FETs which constitute the temperature sensing oscillator circuit 36, and some deviations will occur in the offset level and slope of the temperature characteristic of period $\tau$, and hence in the relationship between temperature data value T and temperature, these deviations being due to manufacturing variations. To correct these deviations, i.e. to eliminate their effects upon the temperature data value T, the values of numeric values A and B stored in memory circuit 28 are adjusted such as to provide the desired characteristic for temperature data value T. It should be noted that it is possible to perform such adjustment using only two numeric values A and B because of the excellent linearity of the temperature characteristic of temperature sensing oscillator circuit 36. This high degree of linearity means that the present invention can be applied not only to timekeeping rate temperature compensation, but also to a system for measurement of ambient temperature, which can be incorporated into an electronic timepiece.

FIG. 5(*b*) shows the relationship between temperature and the temperature data value T, with T having been converted into a set of parallel digital data signals, for input to temperature register 46. Return from the overflow state of comparison counter circuit 40 is indicated by the broken-line portions. Assuming that comparison counter circuit 40 has p bits, then the maximum count which can be attained therein is $2^p-1$, and the temperature characteristic has a stepped configuration, with $2^p$ steps. However, the characteristic is shown as a smooth line in the diagram. The equation given above for temperature data value T can be rewritten as follows:

$$T=[A\times\tau\times fc]+B-2^p\times m$$

Here, the quantity within the brackets has been converted to an integer. The temperature characteristic of period $\tau$ of temperature sensing oscillator circuit 36 can be considered to be substantially linear, as stated above, and hence can be expressed by the following:

$$\tau=\alpha\times\theta+\tau o$$

In the above, $\theta$ represents temperature, $\tau o$ is the value of period $\tau$ at 0° C., and $\alpha$ is the temperature coefficient. Thus, temperature data value T can be expressed as follows:

$$T=[A\times fc\times(\alpha\times\theta+\tau o)]+B-2^p\times m$$

Figure 6:
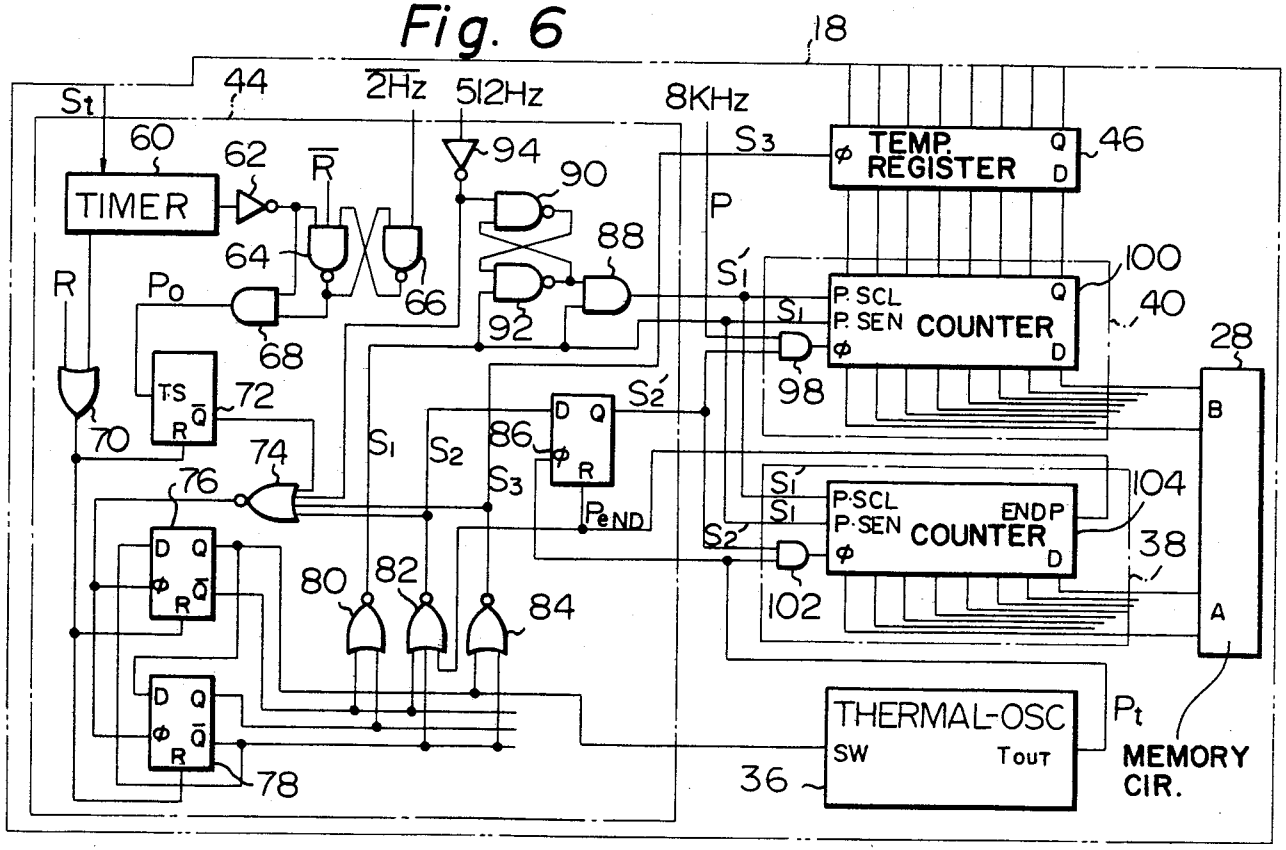
FIG. 6, FIG. 7, FIG. 8, FIG. 10, FIG. 11, FIG. 14 and FIG. 16 show block circuit diagrams of important portions of embodiments of electronic timepieces according to the present invention.

FIG. 6 shows a specific example of temperature measurement circuit 18 shown in FIG. 4. The contents of control section 44 will first be described. Numeral 60 denotes a timer circuit, which generates a negative-going signal after a predetermined number of pulses of a timing signal St from frequency divider circuit 12 have been counted. Signal St can have a period of one second or two seconds, for example. Numeral 62 denotes an inverter which inverts the output signal from timer 60 to a positive-going signal. Numerals 64 and 66 are AND gates constituting a latch circuit, which receive as input signals the output signal from inverter 62 and an inverted 2 Hz signal, $\overline{2HZ}$. Numeral 68 denotes an AND gate which receives the output signal from AND gate 64 and the output from inverter 62, and which generates a one-shot signal Po. A flip-flop (referred to hereinafter as FF) 72 is set on the negative-going edge of signal Po from AND gate 68. A NOR gate 74 receives as inputs the signals S2 and SY, the inverted 12 Hz signal, $\overline{12Hz}$, and the inverted output signal from FF72. Numerals 76 and 78 denote data-type flip-flops (abbreviated hereinafter to D-FF) which are triggered into the set state on the negative-going edges of the output signals from NOR gate 74. D-FF 76 receives the inverted output signal from D-FF 78 as a data input, while D-FF 78 receives the output signal from D-FF 76 as a data input.

Numerals 80, 81, 82 and 84 denote NOR gates which produce sequential control signals in response to the output signals from D-FF 76 and 78, i.e. which generate output signals S1, S2 and D3 respectively. Numerals 90 and 92 denote AND gates which constitute a latch circuit, receiving as inputs the signal S1 and the inverted 512 Hz signal, $\overline{512Hz}$, from inverter 94. An AND gate 88 produces the output signal S1', which is the logical product of signals S1 and the output signal from NAND gate 92. A D-FF 86 produces the output signal S2', in resonse to signal S2 applied as a data input and the output signal $P\tau$ from the temperature sensing oscillator circuit 36 which is applied as a clock signal.

An OR gate 70 serves to reset FF 72, D-FF 76 and D-FF 78. In this embodiment, the input signals applied to OR gate 70 comprise the timepiece overall reset signal R and a ¼ Hz square-wave signal which is produced within timer circuit 60. Gate signal counter circuit 38 comprises an AND gate 102 and a presettable down counter 104. AND gate 102 produces the logical product of signal $P\tau$ from temperature sensing oscillator circuit 36 and signal S2' from control section 44. The presettable down counter 104 receives the signal output from AND gate 102 as a clock signal, receives signals S1 and S1' from control section 44 as a preset enable signal and a preset signal, respectively, for reading the numeric value A which is applied from memory circuit 28. After counting by down counter 104 is initiated, it is continued until A pulses of the clock signal have been counted, and is then terminated. When this occurs, and end pulse Pend is generated, and sent to control section 44.

The comparison counter circuit 40 comprises an AND gate 98 and a presettable counter 100. AND gate 98 generates the logical product of signal S2' from control section 44 and an 8 Hz signal Pc which is input from frequency divider circuit 12. Presettable counter 100 receives the output signals from AND gate 98 as a clock signal, signals S1 and S1' from control section 44 as preset enable and preset signals respectively, for presetting the numeric value B from memory circuit 28, and performs up-counting, starting from the initial value B, until input of the clock signal is terminated. Output signals representing the count contents of counter 100 are sent over a set of bus lines to temperature register 46.

The temperature register 46 is a latch circuit, having an identical number of bits to comparison counter circuit 40, and receives signal S3 as a latch timing signal, applied to terminal $\phi$.

The temperature sensing oscillator circuit 36 is set in operation only while a high logic level signal is being applied to terminal SW. Terminal SW is coupled to the output terminal Q of D-FF 76 of control section 44. The oscillation signal P producted by temperature sensing oscillator circuit 36 is applied to gate signal counter circuit 38 and to control section 44.

The operation of the circuit of FIG. 6 is broadly as described for the block diagram of FIG. 4. Signals S1, S2 and S3 are generated sequentially, with the rising edge of signal S1 being delayed by approximately 0.25 seconds with respect to the output signals from timer circuit 60 which are used to produce signal Po. The reason for this delay is that the present embodiment comprises a hands display constituting the display device 16, so that it is desirable to initiate temperature measurement at a different timing from generation of stepping motor drive signals to advance the hands. When FF 72 is set by signal Po, the 512 Hz signal is transferred to D-FF 76 and D-FF 78 as a clock signal, and D-FF 76 is set first. On the next rising edge of sequence signal S1, oscillation by temperature sensing oscillator circuit 36 is initiated, and preset enable signals are applied to gate signal counter circuit 38 and comparison counter circuit 40. Next, on the rising edge of signal S1', the numeric values A and B stored in memory circuit 28 are preset into gate signal counter circuit 38 and comparison counter circuit 40 respectively. Both of D-FF 76 and D-FF 78 are set by the 512 Hz signal, and signal S1 falls to the low logic level, while signal S2 rises. By this time, the operation of temperature sensing oscillator circuit 36 has reached a sufficiently stable condition, and D-FF 86 is set by the oscillation signal $P\tau$, to thereby generate signal S2' at the high logic level. Input of clock signal pulses to both gate signal counter circuit 38 and comparison counter circuit 40 is thereby enabled, simultaneously.

At this time, the clock signal of gate signal counter circuit 38 is oscillation signal $P\tau$, while the clock signal of comparison counter circuit 40 is signal Px, i.e. a signal of 8192 Hz in this embodiment. As a result of signal S2 being input to NOR gate 74, so that transfer of the 512 Hz signal is inhibited, the end pulse Pend from gate signal counter circuit 38 is continuously output until the falling edge of signal S2.

When gate signal counter circuit 38 has counted A pulses of signal $P\tau$, an end pulse Pend is output therefrom, which resets D-FF 86 in control section 44. Thus, signal S2' falls, and AND gates 102 and 98 are inhibited. As a result, the clock signal finput to gate signal counter circuit 38 is terminated, while at the same time signal Pend is input to NOR gate 82, so that signal S2 falls to the low logic level, and NOR gate 74 is enabled. The 512 Hz signal is thereby input once more to DFF 78. On the next pulse of the 512 Hz signal, D-FF 76 is reset and D-FF 78 is set, while output signal S3 from NOR gate 84 rises to the high logic level.

At this time, temperature data value T is contained in the comparison counter circuit 40, and so is transferred therefrom into temperature register 46 on the falling edge of signal S3. Since signal S3 is input to NOR gate 74 simultaneously with signal S2, the 512 Hz signal becomes inhibited from transfer through gate 74, so that sequence control operations are halted. In this condition, the ¼ Hz square wave signal from timer circuit 60 is sent to OR gate 70, FF 72 and D-FF 76 and 78 are reset and remain in that state until the falling edge of signal S3. The latter reset operation occurs 2 seconds after a negative-going signal input has been applied to inverter 62 from timer circuit 60, and 1.5 seconds after signal Po rises. This timing is arranged to match the compensation cycle of correction signal synthesizing circuit 27 (described hereinafter).

The inverted timer reset signal R is input to NAND gate 74, so that temperature correction operations will be initiated immediately after the reset state has been released. Instead of using a down counter for the gate signal counter circuit 38, it is possible to implement the function of that circuit by using a coincidence detection circuit to detect when a predetermined count value has been attained.

Figure 7:
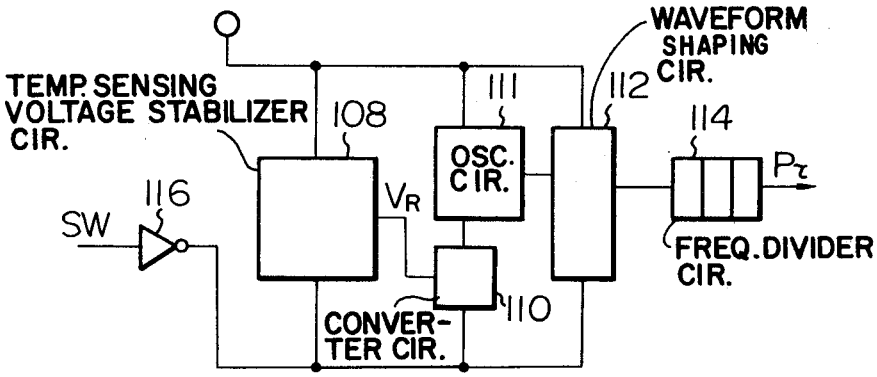

FIG. 7 is a block diagram showing the configuration of temperature sensing oscillator circuit 36. Numeral 108 denotes a temperature-sensing voltage stabilizer circuit which produces an output voltage that is highly stabilized against changes in power source voltage (i.e. against changes in the timepiece battery voltage), and which varies in a substantially linear manner with changes in operating temperature. Numeral 110 denotes a voltage-to-current converter circuit which converts the output voltage of temperature-sensing voltage stabilizer circuit 108 into a current. Numeral 111 denotes a current-controlled oscillator circuit, which in this embodiment is a ring oscillator circuit, whose supply current is provided from voltage-to-current converter circuit 110. The output signal from oscillator circuit 111 is input to an oscillation signal waveform shaping circuit 112, and the output pulses produced thereby are input to a frequency divider circuit 114. The latter circuit frequency divides the signal from oscillator circuit 111 to a sufficient degree to provide a suitable length for the period $\tau$ of signal P$\tau$ which is output from temperature sensing oscillator circuit 36. Supply of power to circuits 108, 110 (and hence 111) and 112 is controlled by an inverter 116, in accordance with signal SW applied thereto. Inverter 116 comprises an N-channel FET having a low value of ON resistance. When signal SW (applied to the gate electrode of that FET) is at the high logic level, operating current is supplied to temperature-sensing voltage stabilizer circuit 108, voltage-to-current converter circuit 110, and waveform shaping circuit 112. The period of oscillation of ring oscillator circuit 111 varies in proportion to the supply current provided by voltage-to-current converter circuit 110, while the level of that current is determined by the threshold voltage (hereinafter abbreviated to Vth) of a an N-channel FET constituting voltage-to-current converter circuit 110 and the output voltage Vr from temperature-sensing voltage stablizer circuit 108. Thus, as the temperature rises, the difference between Vth and Vr is reduced, so that the current supplied by voltage-to-current converter circuit 110 is reduced and hence the period of oscillation of ring oscillator circuit 111 is reduced. The temperature characteristic of this oscillation period has been described hereinabove with reference to FIG. 5, and as stated previously, the period of the output signal from temperature sensing oscillator circuit 36 and hence from frequency divider 114 is defined as $\tau$.

Figure 8:
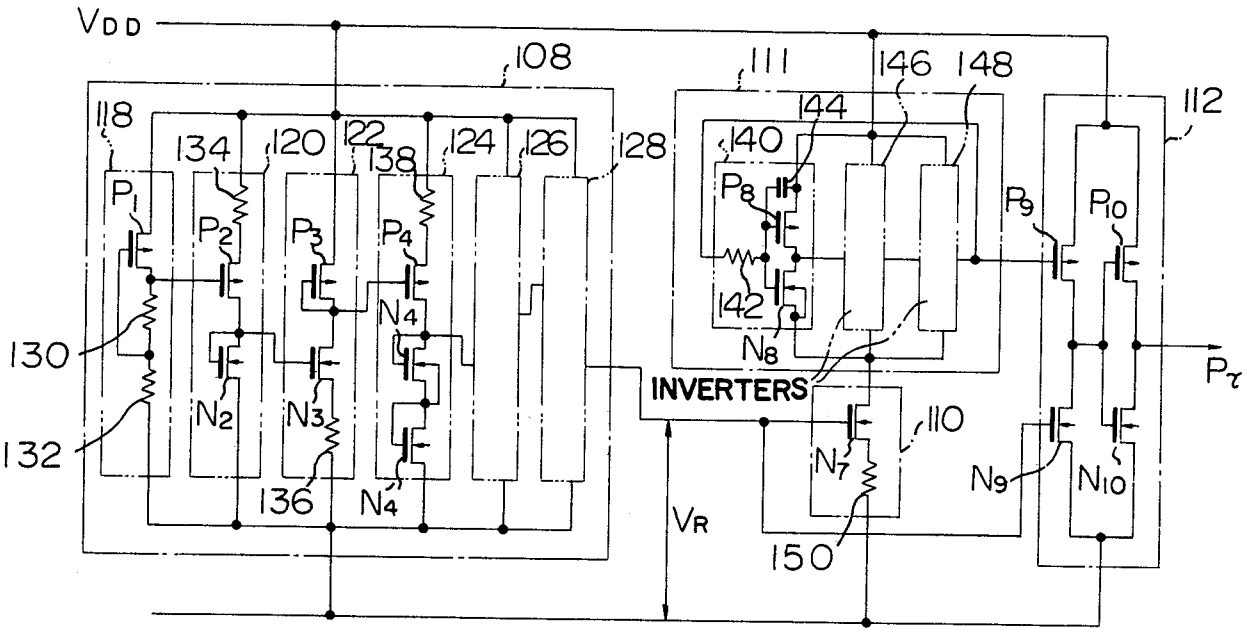

FIG. 8 is a circuit diagram showing details of the temperture-sensing voltage stabilizer circuit 108, voltage-to-current converter circuit 110, ring oscillator 111, and waveform shaping circuit 112 of FIG. 7. The temperature-sensing voltage stabilizer circuit 108 comprises six voltage stabilizer stages connected in cascade, made up of diffused resistors and field effect transistors (FETs). The circuit is based on the use of FETs with gate and drain electrodes connected in common, operating as zener diodes, i.e. as two-terminal devices. The only exception to this is the first stage 118. In this case, a voltage divider circuit is formed between a P-channel FET P1 and resistor 132, so that the output voltage from that circuit tends to be strongly affected by changes in the power source (i.e. battery) voltage. To reduce this effect, a resistor 130 is coupled between the gate and drain electrodes of FET P1, to stabilize the drain-to-source voltage. The second and subsequent stages 120, 122, 124, 126 and 128 comprise FETs P2, N3 and P4 respectively each connected in source follower configuration, and connected in series with FETs N2, P3, and the pair N4 and N4′ respectively, each of which has gate and drain electrodes connected together as shown. The fifth stage 126 and sixth stage 128 are identical to the third stage 124 and the second stage 120, respectively. Due to the current-limiting action of the source-follower transistors on the current passed through the transistors connected as two-terminal elements, the voltage developed across the latter transistors is highly stabilized against changes in power source voltage, and the degree of stabilization increases as the number of stages, i.e. stages 120, 122, etc, increases. Furthermore, as the number of stages increases, the output voltage from each stage increasingly tends toward the threshold voltage Vt of the transistors which are connected as two-terminal elements. This threshold voltage has a negative temperature coefficient, i.e. it falls as the operating temperature increases. Two FETs N4 and N4′ are connected in series as two-terminal elements in the fourth stage 124, in order to provide a higher level of output voltage from that stage and so increase the level of current which flows in the fifth and sixth stages, to thereby assure sufficient current flow in these stages for satisfactory operation. Another objective of this configuration of stage 124 is to increase the operating temperature range, by doubling the slope of the temperature characteristic of the output voltage from the final stage, Vr, due to the output voltage from stage 124 being the sum of the threshold voltages of two FETs. Due to this, as the temperature increases, the resultant drop is output voltage from fourth stage 124 causes the current flowing in final stage 126 to be reduced, thereby increasing the slope of the overall temperature characteristic of temperature-sensing voltage stabilizer circuit 108. As the temperature increases, therefore, the output voltage Vr from sixth stage 126 tends toward the threshold voltage Vt.

The temperature characteristic of the output voltage Vr obtained from this circuit is almost completely unaffected by changes in power source voltage, and varies only in accordance with changes in operating temperature. The slope of this temperature characteristic of Vr is determined by the temperature characteristic of the threshold voltage Vt of the FET which is used as a two-terminal element in the final stage 126 of temperature-sensing voltage stabilizer circuit 108, primarily, but is also determined to a certain extent by the temperature characteristic of the threshold voltage of the FETs used in the fourth stage 124.

The diffused resistors 134, 136 and 138 each has a positive temperature coefficient, so that they tend to reduce the flow of current as the temperature increases. However it has been determined that the effects of this upon output voltage Vr are not significant.

Figure 9:
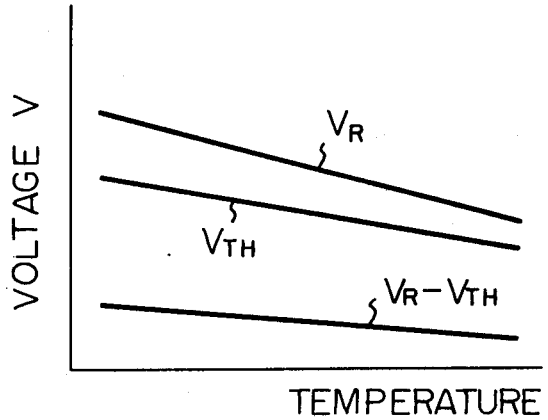

The voltage-to-current converter circuit 110 serves to convert the output voltage Vr from temperature-sensing voltage stabilizer circuit 108 into a current, which will vary with temperature in accordance with changes in Vr. The temperature characteristic of the threshold voltage of N-channel FET N7 in voltage-to-current converter circuit 110 must therefore be taken into consideration. If this temperature characteristic is identical to that of voltage Vr, then the difference between the threshold voltage of FET N7 and the voltage Vr applied to its gate electrode will not vary with temperature, so that the current flowing through FET N7 will not change with temperature. With the present invention all of the FETs of temperature-sensing voltage stabilizer circuit 108 and voltage-to-current converter circuit 110 are formed in the same IC chip, so that it is easy to arrange that the characteristics of the FETs in each of these circuits are identical. As described above, the slope of the temperature characteristic of voltage Vr is made steeper than that of the threshold voltage of the FETs, due to the configuration of temperature-sensing voltage stabilizer circuit 108, and this ensures suitable current control with temperature changes by voltage-to-current converter circuit 110. The relationship between threshold voltage Vth of N-channel FET N7 and voltage Vr is shown in FIG. 9. As shown, the difference (Vr−Vth) changes linearly with temperature, so that the drain current of FET N7 also varies linearly with temperature. The temperature characteristic of (Vth−Vr) can be adjusted to some extent by variation of source follower resistor 150 in voltage-to-current converter circuit 110.

Ring oscillator 111 comprises three inverters, 140, 146 and 148, each comprising a P-channel FET and an N-channel FET, with supply current for each of these inverter stages being supplied from voltage-to-current converter circuit 110. Each inverter stage includes a delay circuit, such as that formed by resistor 142 and capacitor 140, and the inverters are connected to form a ring oscillator circuit. It is possible to use more than three stages for this oscillator circuit, if the number of stages is odd. Furthermore, it is not essential that a ring oscillator circuit be used, and other types of oscillator may be utilized, provided that the oscillation frequency is current-dependent.

With this embodiment, it is arranged that the current supplied to oscillator circuit 111 is reduced as the temperature increases, so that the frequency of oscillation of circuit 111 increases with temperature. At the same time, the amplitude of the output signal from oscillator 111 increases with temperature, so that it is necessary to provide waveform shaping circuit 112 to convert the latter output signal to vary between the logic level potentials of the digital circuitry. In circuit 112, an N-channel transistor N9, having voltage Vr applied to its gate electrode, functions as a pull-down resistor. The output signal from ring oscillator circuit 111 is input to P-channel FET P9 and amplified thereby, then inverted by an inverter stage comprising FETs P10 and N10, and output as signal $P\tau$.

It can be understood from the above description that temperature sensing oscillator circuit 36 is a combination of circuits known in the prior art, but produces an output signal having a period of oscillation which is almost exactly proportional to operating temperature, within the temperature range −20° C. to +80° C., yet does not require the use of external temperature-sensing elements, being composed entirely of FET elements and diffused resistors which are integrally formed within the timepiece IC chip. In addition, the supply current drawn by temperature sensing oscillator circuit 36 can be made less than 5 μA, and since this circuit is set in operation on an intermittent periodic basis, under the control of signals from control section 44, the average level of current drawn by temperature sensing oscillator circuit 36 is negligible, in practice. This use of temperature sensing oscillator circuit 36 on a periodic intermittent basis, e.g. operation during a short interval once in every 30 seconds, is also possible if temperature sensing oscillator circuit 36 is used to provide other temperature-related functions besides temperature compensation. In this embodiment, temperature sensing oscillator circuit 36 is set in operation for only 0.1 seconds, each time a temperature sensing operation is performed, so that the average current drawn by that circuit is less than 0.01 μA. If the temperature sensitivity is measured with reference to the oscillation period at normal operating temperature, then it has a substantially high value, i.e. 4000 to 8000 ppm. Thus, even if a high degree of resolution is required, excellent sensitivity for temperature compensation can be attained.

The functions for adjustment of the two set values A and B of temperature measurement circuit 18 will now be described. In the following, it will be assumed that temperature measurement circuit 18 is to provide a value of temperature data value T equal to zero at 0° C., and a value of T equal to 500 at 50° C., so that the temperature resolution is to be 0.1° C. It will further be assumed that the characteristics of temperature sensing oscillator circuit 36 are such that $\alpha=5$ microseconds/°C, $\tau o=650$ microseconds, and fc=8192 Hz, p=9 bits. It will also be assumed that values of 244 for A and 237 for B have been set.

Thus, $T=[9.994\times\theta+129.93]+237-512\times m$

If the temperature is 20° C., then T=200, so that if the decimal point is attached, T can be expressed as "20.0". Similarly, at 40° C., T equals 400, and by inserting the decimal point this can be expresed as "40.0". Such a high degree of resolution is of course not necessary if temperature measurement circuit 18 is only to be used to provide a temperature measurement and display function in the electronic timepiece. In such a case, the temperature measurement range can be broadened, and the number of bits in comparison counter circuit 40 and temperature register 46 can be reduced, to thereby simplify the circuitry. In addition, the most significant bit of temperature register 46 (hereinafter abbreviated to MSB) can be used to indicate the sign.

Thus in this case, if A=122, B=119, then the temperature data value T is given as:

$$T=[4.997\times\theta+64.96]+119-512\times m$$

assuming that other parameters are indentical to those given for the last example. In this case, the value of T at 25° C. is 381, and if the decoded value of the 8 bits less the MSB is designated as n, then:

$$n=(381-256)=125$$

If this value is doubled and the decimal point attached, it becomes "25.0". Similarly, at −10° C, T=206 and so the value of n in this case is 206. By recognizing that the MSB is zero, and thereby setting into operation a circuit for computing (256−n), a value n′=50 can be obtained. If this doubled and has a minus sign attached and a decimal point inserted, it expresses the value "−10.0". In this way, temperature measurement circuit 18 can readily be adapted to provide a direct temperature readout function in an electronic timepiece.

Alternatively, in the latter case, by recognizing that the MSB is zero, and assigning a minus sign to the value of n, and this value (i.e. that of the 8 bits less the MSB) is inverted and then decoded, a value for n' of 49 can be obtained. If this is then doubled, and a minus sign and decimal point attached, it expresses the value "−9.8".

Figure 10:
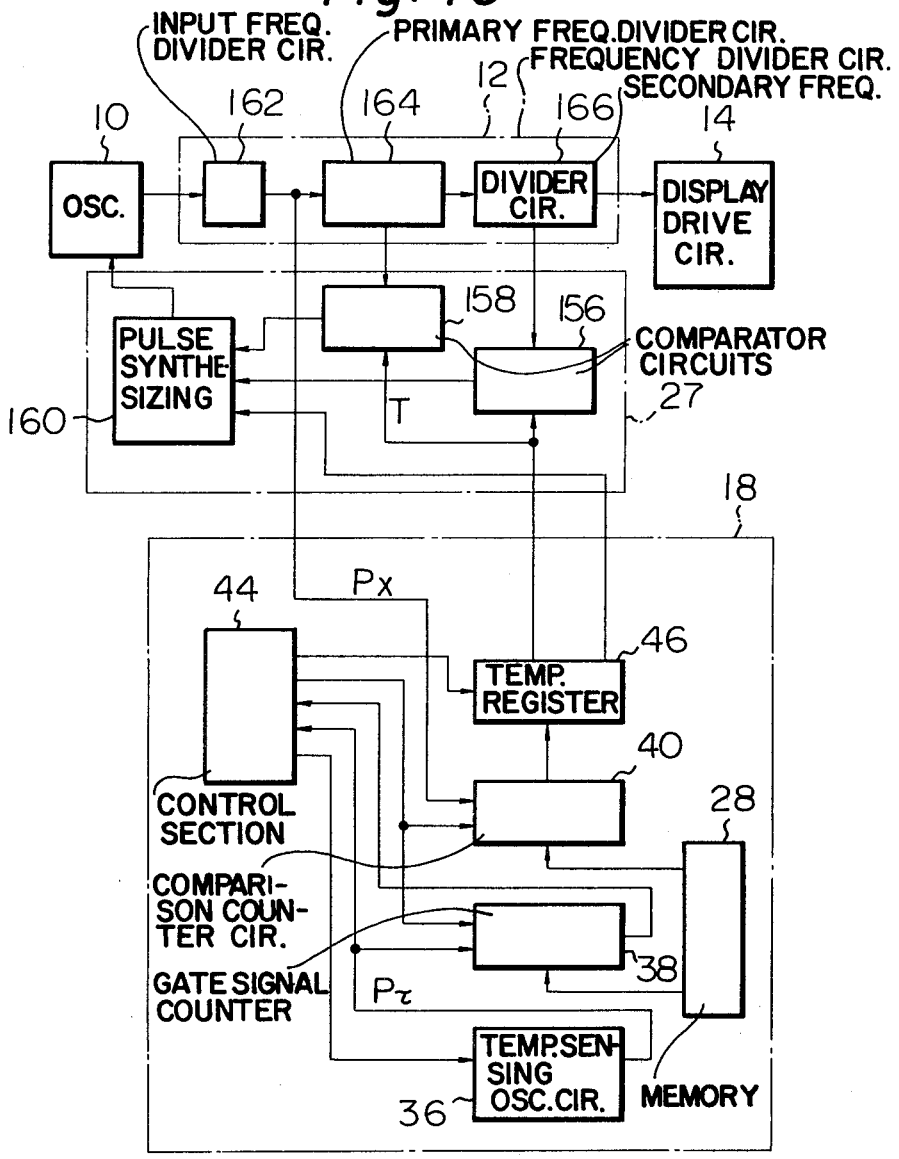

A specific example of correction signal synthesizing circuit 27 shown in FIG. 4 will now be described, with reference to the block circuit diagram of FIG. 10, which also includes a configuration for frequency divider circuit 12. Frequency divider circuit 12 comprises an input frequency divider circuit 162, a primary frequency divider circuit 164 coupled to receive the output from circuit 162, and a secondary frequency divider circuit 166 coupled to receive the output signal from primary frequency divider circuit 164. The correction signal synthesizing circuit 27 comprises a first comparator circuit 158 which produces an output signal having a pulse width determined by the temperature data value T, through comparison between the temperature data value T from temperature register 46 and output signals from first frequency divider circuit 164, and a second comparator circuit 156 which produces an output signal whose pulse width is determined in accordance with temperature data value T by comparison between temperature data value T and output signals from second frequency divider circuit 166. Correction signal synthesizing circuit 27 further comprises a pulse synthesizing section 160 which synthesizes a frequency correction signal Pc using the output signals from comparator circuits 156 and 158 and from a part of the temperature data stored in temperature register 46. Quartz crystal oscillator circuit 10 is provided with terminals for producing frequency switching by that circuit. This frequency switching is performed in accordance with the output signal applied to the latter terminal from pulse synthesizing section 160 of correction signal synthesizing circuit 27 is at the high logic level (hereinafter referred to as the H level) or the low logic level (hereinafter referred to as the L level).

More specifically, frequency switching is performed by changing a part of the oscillation circuit capacitance of quartz crystal oscillator circuit 10. If the temperature data value T from temperature register 46 is assumed to comprise 8 bits, then the 7 lower significance bits, i.e. without the MSB, are applied to comparator circuit 156 and 158, while the MSB is applied directly to pulse synthesizing section 160. Thus, the first comparator circuit 158, second comparator circuit 156, first frequency divider circuit 164 and second frequency divider circuit 166 each has a 7-bit logic configuration.

Figure 11:
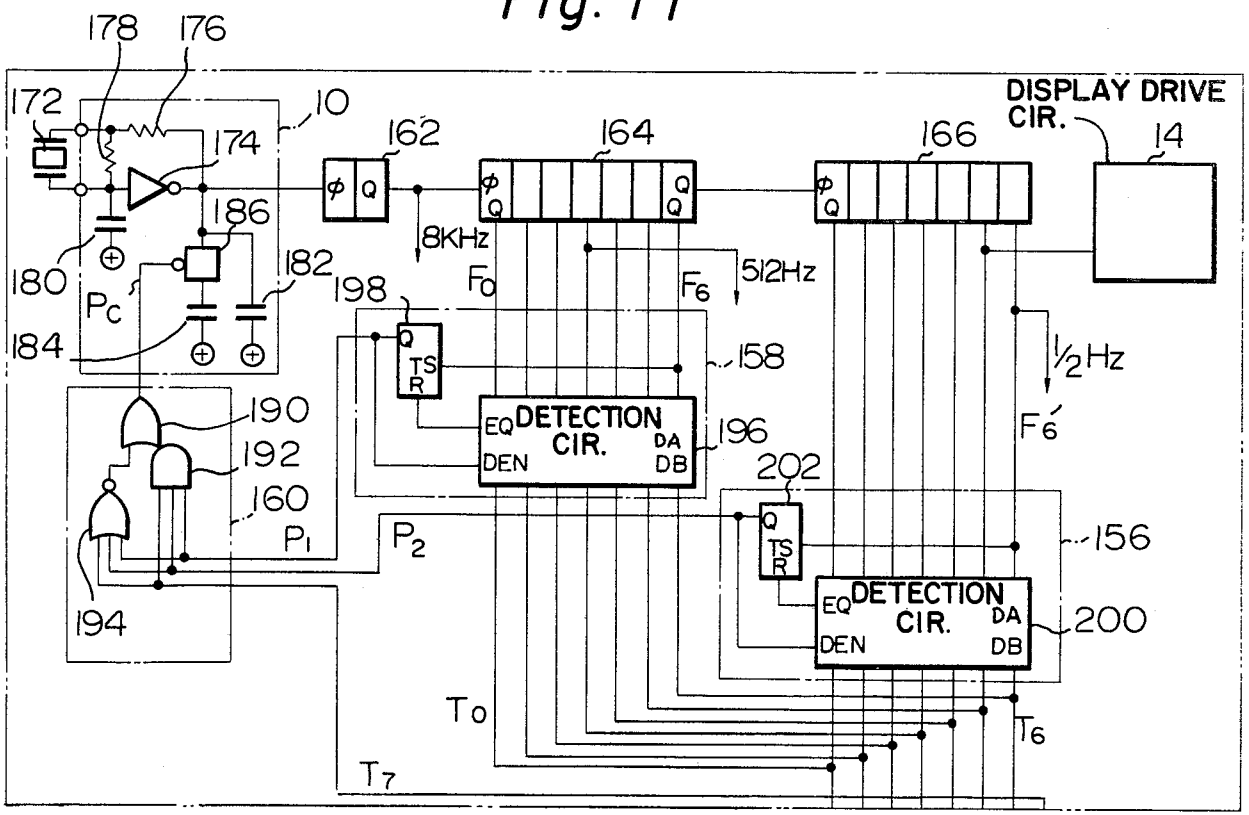

FIG. 11 is a circuit diagram for describing these frequency switching operations, and shows the circuit diagrams of quartz crystal oscillator circuit 10 and correction signal synthesizing circuit 27, as well as frequency divider circuit 12. The quartz crystal oscillator circuit 10 comprises a 32876 Hz quartz crystal vibrator 172, oscillator inverter 174, stabilizing resistor 176, feedback resistor 178, oscillator input capacitor 180, and oscillator output capacitor 182, and further comprises a switching capacitor 184 which is selectively switched into the circuit through the operation of an electronic switch 186. The input frequency divider circuit 162 comprises two binary divider stages. The primary and secondary frequency divider circuits 164 and 166 each comprise 7 binary divider stages. The output signals from these binary divider stages of primary frequency divider circuit 164 and secondary frequency divider circuit 166 are connected to corresponding input terminals of first comparator circuit 158 and of second comparator circuit respectively, as shown in FIG. 11. First comparator circuit 158 comprises flip-flop 198 and coincidence detection circuit 198. FF 198 is triggered to produce a positive-going output on the negative-going edge of MSB signal F6 of the 7 bits F0 to F6 which are input to coincidence detection circuit 196 from frequency divider circuit 12. The coincidence detection circuit 196 resets FF 198 by generating a coincidence output signal, when the 7 bits T0 to T6 from temperature register 46 are identical to the 7 bits F0 to F6 from primary frequency divider circuit 164. The second comparator circuit 156 comprises flip-flop 202 and coincidence detection circuit 200, and has the same configuration as first comparator circuit 158, but compares the 7 bit signals output from secondary frequency divider circuit 166 with the 7 bits T0 to T6 from temperature register 46.

The pulse synthesizing section 160 comprises an AND gate 192, which receives as input signals the MSB signal T7 from temperature register 46, output pulses P1 and P2 from first comparator circuit 158 and second comparator circuit 156 respectively, and further comprises an OR gate 194 which receives pulse signals P1 and P2 and an OR gate 190 which receives the output signals from gates 192 and 194. The operation of correction signal synthesizing circuit 27 is as follows. If the value represented by the 7 most significant bits T0 to T6 of temperature register 46 is designated as n, and if the signal period of least significant bit (hereinafter abbreviated to LSB) F0 of primary frequency divider circuit is assumed to be 1, then the periods of the output pulse signals P1 and P2 from comparator circuits 158 and 156 are 128 and 16384, respectively. The duty cycle of the latter signals, i.e. the time-sharing ratio for which each signal is at the H level, will be n/128. The pulse synthesizing section 160 serves to set the output signal from NOR gate 194 at the L level when the MSB T7 from temperature register 46 is at the H level, and to generate the logic product of P1 and P2 from AND gate 192, while the output signals from gates 192 and 194 are transferred through OR gate 190 to be applied to electronic switch 186 of quartz crystal oscillator circuit 10. If the signal applied to switch 186 is designated as correction signal Pc, then the time for which signal Pc is at the H level during 16384 periods of that signal will be $n^2$, and the duty cycle $\phi$ (which will be referred to hereinafter as the correction ratio) is given by the following equation:

$$\phi = n^2/16384$$

While bit signal T7 is at the L level, the output from AND gate 192 is fixed at the L level, and the inverse signal $\overline{P1}$ of signal P1, and the inverse signal $\overline{P2}$ of signal P2 will be output from NOR gate 194, i.e. the logic product $\overline{P1}\cdot\overline{P2}$ is output from that gate, and is applied through OR gate 190 to electronic switch 186. In this case, the time for which signal Pc is at the H level is given as $(128-n)^2$. The following relationships exist between the value n and the bits of the temperature data value T from temperature register 46:

$$n = T \ (0 \leqq T < 128)$$

$$n = T - 128 \ (128 \leqq T \leqq 255)$$

Thus, the correction ratio $\phi$ is given by the following equation:

$$\phi=(T-128)^2/16384\ (0\leqq T\leqq 255)$$

Thus, correction signal synthesizing circuit 27 acts to convert the temperature data value T into a quadratic function.

The correction signal Pc is generated periodically, as a continuous pulse train having a period of 1/64th second during a certain time interval, and then halted during a succeeding time interval. The pulse width of the pulses in that pulse train, and the duration of the pulse train, are determined in accordance with the temperature data value T. The period of repetition of these intervals in which the pulse train is halted is 2 seconds, so that the average timekeeping rate of the timepiece during 2 seconds is taken as representing the timekeeping rate.

Figure 12A:
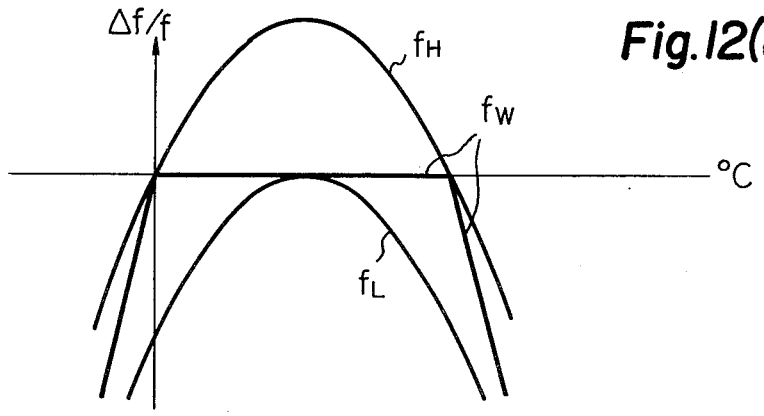
Figure 12B:
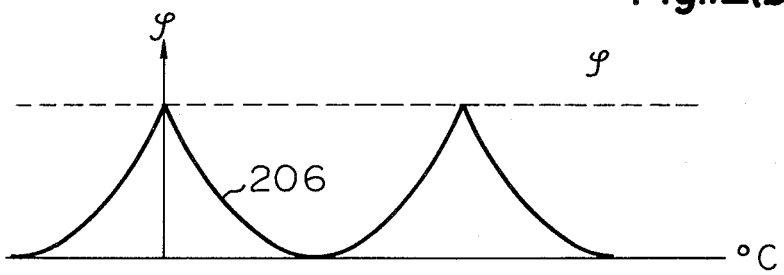
Figure 12C:
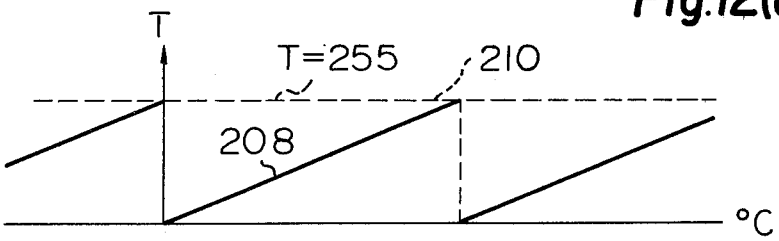

The operation of quartz crystal oscillator circuit 10 in response to correction signal Pc will now be decribed. FIG. 12 shows the temperature characteristic of an electronic timepiece according to the present invention, with FIG. 12(*a*) showing the temperature characteristic of quartz crystal oscillator circuit 10, FIG. 12(*b*) showing the temtemperature characteristic of the correction ratio $\phi$, i.e. of the duty ratio for signal Pc being at the H level, while FIG. 12(*c*) shows the temperature characteristic of temperature data value T. FIG. 12(*a*) has relative frequency deviation plotted along the vertical axis. As shown, the temperature characteristic of quartz crystal oscillator circuit 10 is expressed by two curves, each having a peak temperature which is close to the normal operating temperature. As described in the above, two different output frequencies are obtained from quartz crystal oscillator circuit 10 by switching, and when correction signal Pc applied to switch 186 is at the L level, a frequency deviation of fL is obtained, while when Pc is at the H level, a frequency deviation of fH is obtained. The value of frequency deviation is adjusted to be zero, at the peak temperature of the fL characteristic. The frequency deviation varies in a substantially constant manner with respect to fL, so that the difference between fL and fH, designated hereinafter as fSW, can be expressed as follows:

$$fL=a\times(\theta-ZT)^2$$

$$fH=a\times(\theta-ZT)^2+fSW$$

In the above, $\theta$ denotes temperature, a is a quadratic temperature coefficient, ZT is the peak temperature, i.e. the temperature at which the characteristics of frequency deviations fL and fH reach a maximum. If fW denotes the average amount of frequency deviation which results from temperature correction, and is equal to the frequency deviation averaged over the period of the MSB signal from secondary frequency divider circuit 166. The correction ratio $\phi$ can be considered to be the duty ratio for which quartz crystal oscillator circuit 10 oscillates at a frequency causing frequency deviation fH, and is a quadratic function. This function is illustrated in FIG. 12(*b*). The average value of frequency deviation fW is therefore given by the following equation:

$$fW=fL\times(1-\phi)+fH\times\phi$$

This can be rewritten as follows:

$$fW=a\times(ZT-\theta)^2-fSW\times(T-128)^2/16384$$

The ideal condition is attained when the quantity fW given by the above equation becomes zero. This condition is met for the following value of T:

$$T=128\times\left[\sqrt{-a/fSX}\times(\theta-ZT)+1\right]$$

This value of T resutls in fW becoming zero.

As explained above, temperature measurement circuit 18 allows the temperature characteristic of the temperature data value T to be appropriately determined, by setting the numeric values A and B stored in memory circuit 28. It is easy to set the temperature characteristic of T such that the quantity fW is made zero. This can be readily performed by automatic processing, by using an electronic computer to set in the appropriate values for A and B. The manner in which A and B are actually calculated to provide the desired temperature data value T will now be described. The preconditions required for this are that the frequency deviation fL is zero at the peak temperature (defined hereinabove) and that switch 186 can be set in the open and closed state selectively by external control means, and that an output terminal is provided to enable the oscillation period of temperature sensing oscillator circuit 36 to be measured. The necessary operations are as follows. First, the temperature characteristics are measured, next, calculation processing is performed, and then the values of A and B are set into memory circuit 28.

Setting is performed for two different temperature points. The values of fL, fH and $\tau$, designated as fL1, fH1 and $\tau 1$, are measured at a first temperature $\theta 1$. Values of fL, fH and $\theta$, designated as fL2, fH2 and $\tau 2$, are then measured at a second temperature $\theta 2$. This enables the corresponding values of fSW, designated as fSW1 and fSW2 to be measured. However, since fH1 and fH2 will be almost identical, it is possible to measure only one of these. The value of correction ratio $\phi$ required to perform compensation of fL1 at temperature $\theta 1$, designated as $\phi 1$, is equal to the ratio fL1/fSW1. The value of correction ratio $\phi$ required to perform compensation of fL2 at the second temperature $\theta 2$, designated as $\phi 2$, is given by the ratio fL2/fSW2. In addition, $$\phi=(T-128)^2/16384$$

Since T is given by the equation:

$$T=A\times fc\times\tau+B-256\times m,$$

the following equations are obtained:

$$fL1/fSW1=\frac{(A\times fc\times\tau 1+B-256\times m-128)^2}{16384}$$

$$fL2/fSW2=\frac{(A\times fc\times\tau 2+B-256\times m-128)^2}{16384}$$

If it is assumed that O1 ZT O2, then the above equations can be solved to give the following equation:

$$A = \frac{128 \times \left( \frac{fL1}{fSW1} + \frac{fH2}{fSW2} \right)}{fc \times (\tau 2 - \tau 1)}$$

and:

$$B = 128 \times \frac{fL1}{fSW2} - A \times fc \times \tau 2 + 256\, m + 128$$

when these values of A and B are set into memory circuit 28, then temperature data value T displays the temperature relationships shown in FIG. 12(*c*), while the temperature characteristic of temperature data value T takes the form shown in FIG. 12(*a*). It is not necessary to measure temperature as a parameter for the data processing computations required to obtain the values of A and B. It is only necessary to measure the relationship between the signal frequencies from quartz crystal oscillator circuit 10 and temperature sensing oscillator 36 at a temperature which is lower than the normal operating temperature and at a temperature which is higher than the normal operating temperature. It is not necessary to determine these measurement temperatures precisely, or to maintain an accurately temperture-stabilized environment during testing.

An alternative method utilizes the fact that the stray deviations in the quadratic temperature characteristic of quartz crystal oscillator circuit 10 and in the frequency/temperature characteristic of temperature sensing oscillator circuit 36, are small. With this method, fH, fL and $\tau$ are measured at the normal operating temperature, and computations then performed to derive the desired values for A and B. This computation processing will be apparent from the equations and explanations given hereinabove, and will not be described in detail.

Various other method of using the temperature measurement circuit of the present invention, in conjunction with correction signal synthesizing circuit 27 and quartz crystal oscillator circuit 10, can be envisaged. For example, the temperature data value T could be converted into a quadratic function of temperature, before being stored in temperature register 46. Alternatively, frequency correction could be implemented by varying the effective frequency division ratio of frequency divider circuit 12, rather than by directly affecting the frequency of oscillation of quartz crystal oscillator circuit 10. This can be achieved by injecting or subtracting pulses, as is well known in the art. Furthermore, it can be arranged that when temperature data value T is calculated as representing a large degree of timekeeping error, for example 1 or 2 seconds, then a method is employed whereby the time indicated by the time display device itself is corrected. However the method of timekeeping rate correction used in the described embodiment is generally preferable. This is due to the fact that electronic timepiece timekeeping rate measurement equipment generally measures the average timekeeping rate over a short period of time, so that the method of direct control of the oscillation frequency of the quartz crystal oscillator circuit 10 is advantageous in this respect.

Figure 13A:
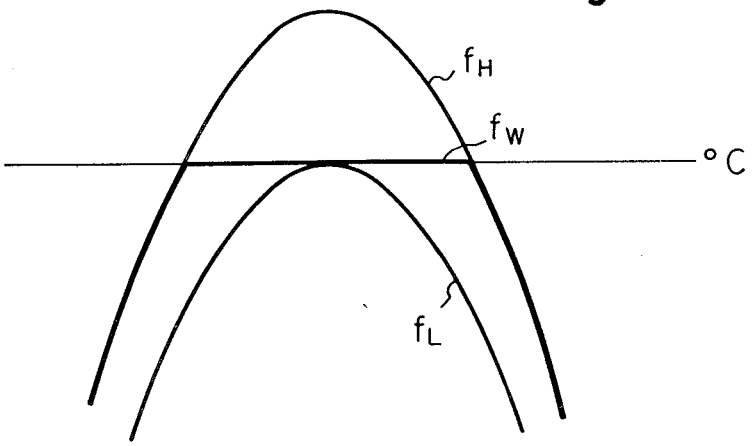
Figure 13B:
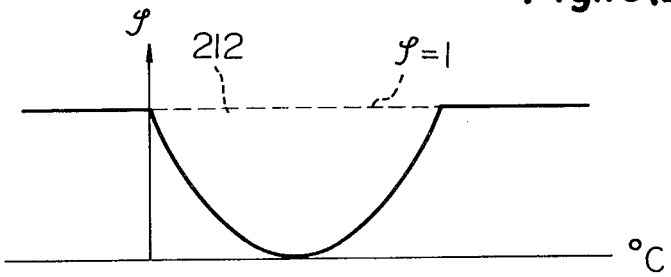
Figure 13C:
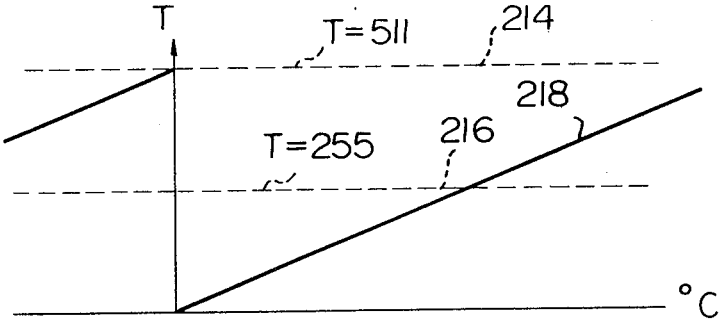

With the present embodiment, as shown in FIG. 12(*a*), fW falls off sharply, in the direction of timekeeping retardation, at temperatures outside the temperature compensation range. This can easily be ameliorated, if desired, by arranging that fW is made equal to fH, at temperatures outside the temperature compensation range. For example, the temperature characteristic shown in FIG. 13 can be obtained by increasing the number of bits in comparison counter circuit 40 and in temperature register 46 of temperature measurement circuit 18, to a total of 9 bits, and further by slightly modifying the configuration of pulse synthesizing section 160 of correction signal synthesizing circuit 27. The difference between FIG. 13(*a*) and FIG. 12(*a*) lies in the fact that in the case of FIG. 13(*a*), frequency deviation fW equals fH outside the frequency compensation range. This is accomplished by making the temperature characteristic of the correction ratio $\phi$ flat, outside the temperature compensation region, as illustrated in FIG. 13(*b*). Thus, as shown in FIG. 13(*c*), the temperature data value T must cover twice the temperature range of that in the case of FIG. 12(*c*).

Figure 14:
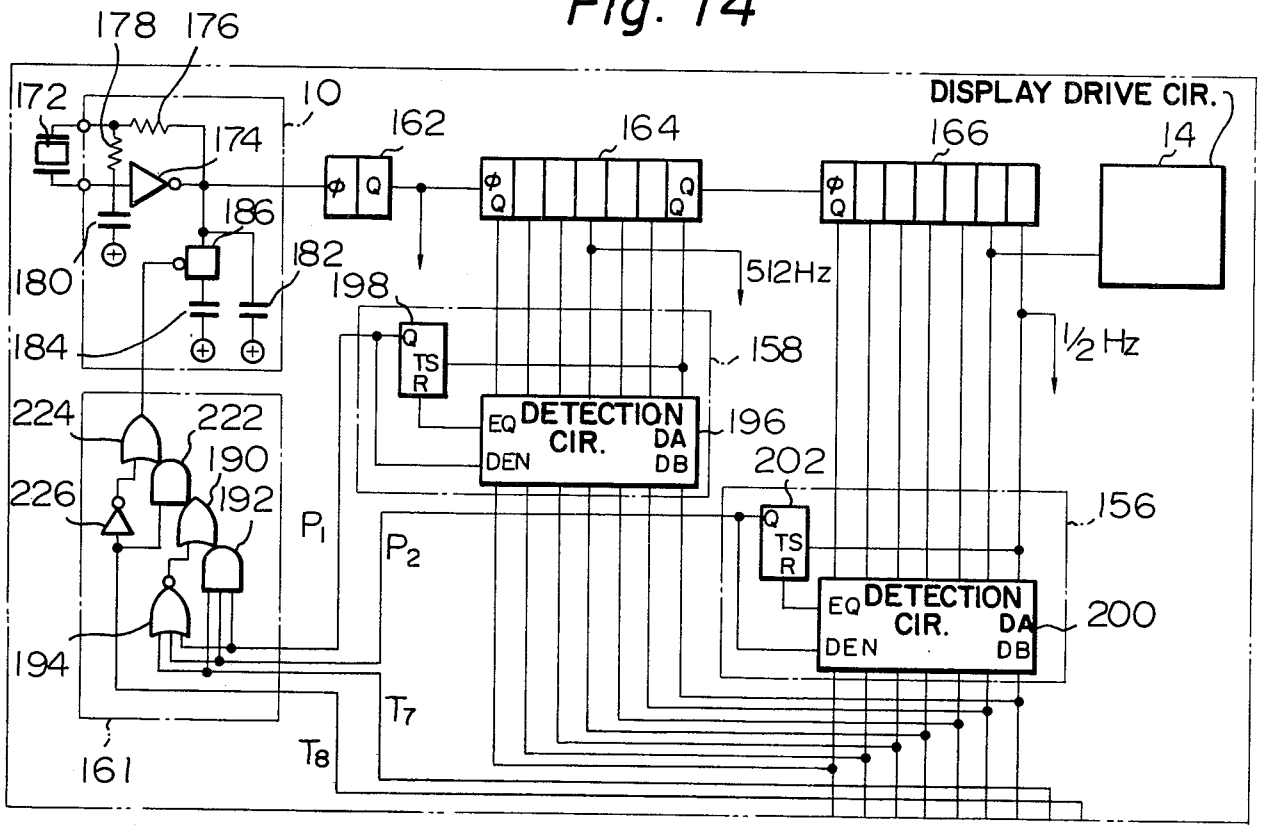

FIG. 14 is a circuit diagram showing a modified version of the embodiment of correction signal synsynthesizing circuit 27 shown in FIG. 11, for producing the temperature characteristics described above and shown in FIGS. 13(*a*) to (*c*). This comprises the pulse synthesizing section 160 in the circuit of FIG. 11, converted to a pulse synthesizing section 161 by the addition of gate circuits. The latter comprise an AND gate 222, an OR gate 224 and an inverter 226. AND gate 222 receives as input signals the frequency correction signal Pc shown in FIG. 11 and the ninth bit signal T8 from temperature register 46 (in this embodiment, expanded by one bit to have 9 bits, but not shown in the drawings). OR gate 224 receives the output signal from AND gate 222 and the inverted output signal T8 applied from inverter 226. The output signal from OR gate is applied as correction signal Pc' to quartz crystal oscillator circuit 10.

With the embodiments of FIG. 13 and FIG. 14, an improvement in the temperature characteristic of the timekeeping rate, at temperatures outside the temperature-compensation region. It is also possible to obtain an improvement of the temperature characteristic within the temperature-compensation region by increasing the number of bits in temperature data value T to 9 bits, as will now be described.

Figure 15A:
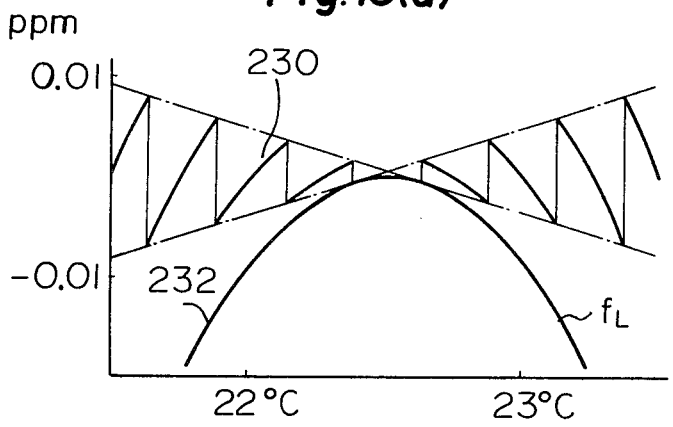
Figure 15B:
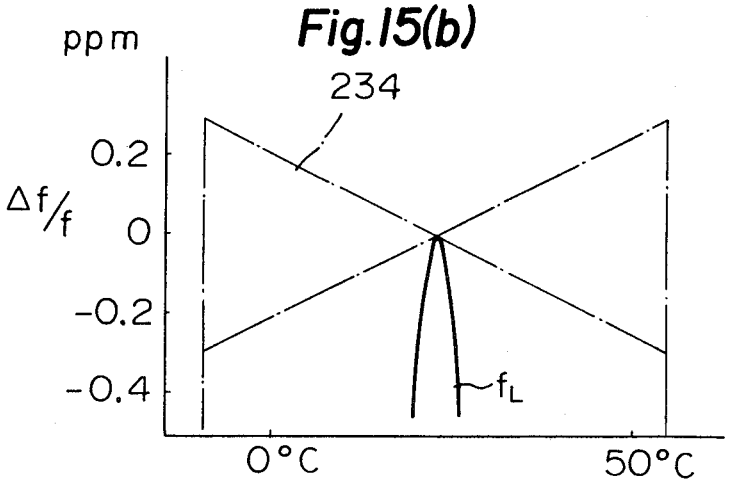

FIG. 15 shows the temperature compensation characteristics of the embodiment of FIG. 1 and FIG. 14, with the vertical axis of the graph expanded. In FIG. 15(*a*), the temperature characteristic in the vicinity of the peak temperature is shown. FIG. 15(*b*) shows the temperature characteristic 230 over the entire temperature compensation region. As shown, the temperature characteristic is discontinuous, with quantization errors occurring. The amplitude of these errors is indicated by the chain lines in FIG. 15(*a*) and (*b*). These quantization errors are due to the operation of the digital circuitry, and must be kept as small as possible. If the 7 bits of each of coincidence detection circuits 196 and 200 and of primary and secondary frequency divider circuits 164 and 166 is increased, then the temperature compensation resolution will be doubled each time the number of bits is increased by one, and the quantization error is halved. However, as the number of these bits is increased, the cycle time of the correction signal synthesizing circuit 27 will be increased above an average of 2 seconds, so that it will not be possible to measure the timekeeping rate over a 2 seconds period. Even if the frequence of clock signal Px is changed from 8192 Hz to 16384 Hz in an attempt to overcome the latter problem, 4 seconds will still be required to perform squaring (i.e.

conversion of temperature data value T to a quadratic function). If the clock signal frequency is increased further, then the current consumption of the circuitry will be increased, and it will become impossible to perform rapid measurement of the timekeeping rate using the usual type of rate measurement equipment.

Figure 16:
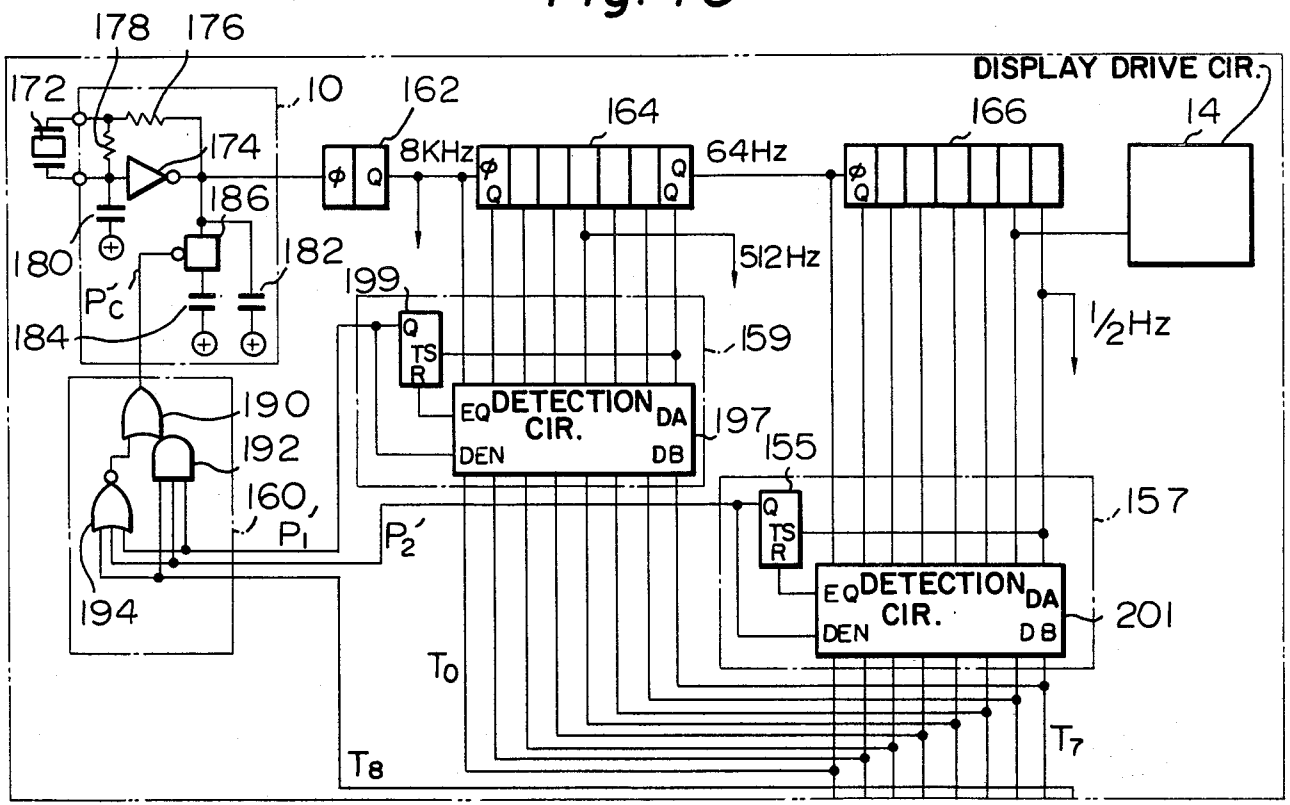

A method whereby the amplitude of the quantization error can be reduced, which avoids the disadvantages described above, will now be described. This uses a different form of squaring circuit, and is shown in FIG. 16. Here, the number of bits in the coincidence direction circuit 197 in the first comparator circuit (now designated as 159) and in the second coincidence detection circuit 201 of the second comparator circuit (here designated by numeral 157) has been increased by one bit, having 8 bits rather than the 7-bit configuration of the previous embodiments. Signal To supplied from the LSB of the temperature register 46 (which has now also been increased by one bit, but is omitted from the drawings) is input as a data signal to the LSB of coincidence detection circuits 197 and 201. The special feature of this circuit is that the signal which is input to the LSB of coincidence detection circuit 197 is the input signal to the primary frequency-divider circuit 164, while the signal which is input to the LSB of coincidence detection circuit 201 is the input signal to secondary frequency divider circuit 166. In addition, the same signal (i.e. of 64 Hz) is input to the MSB of first comparator circuit 159 and to the LSB of second comparator circuit 157. Furthermore, the signal which is input to the MSB of second comparator circuit 157 from frequency divider circuit 12 is the same ½ Hz signal as in the embodiment of FIG. 11. Thus, the squaring operation on temperature data value T can be completed within 2 seconds, with this embodimemt of correction signal synthesizing circuit 27. The signal Pc' which is synthesized from the output signals P1' and P2' of first and second comparator circuits 159 and 157 gives a value of correction ratio $\phi'$ which can be expressed by the following equations:

$$\phi' = \frac{(T-256)^2}{65536} \text{ (when } T \text{ is an even number)}$$

$$\phi' = \frac{|(T-256)^2 + |128 - |T-256||}{65536} \text{ (when } T \text{ is an odd number)}$$

Figure 17A:
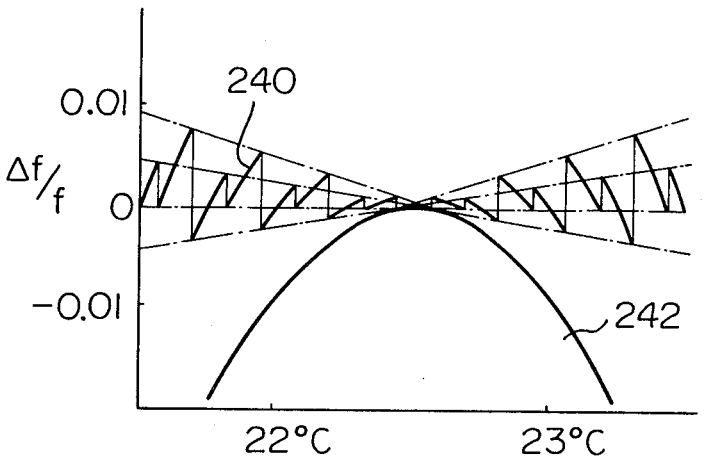
Figure 17B:
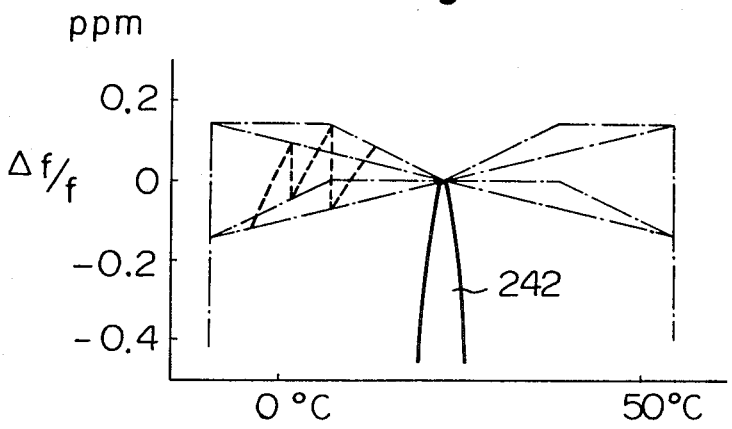

In the above, T' denotes the 9 bits of temperature data (as opposed to the 8 bits of temperature data value T in the previous examples). The temperature compensation characteristics which are obtained from this circuit are shown in FIG. 17. Here, the same co-ordinate axes are used as in FIG. 15. As shown in FIG. 17(*a*), the temperature compensation resolution is twice that of FIG. 15. As shown in FIG. 17(*b*), the maximum amplitude of digital quantization error is half that of FIG. 15.

Figure 18:
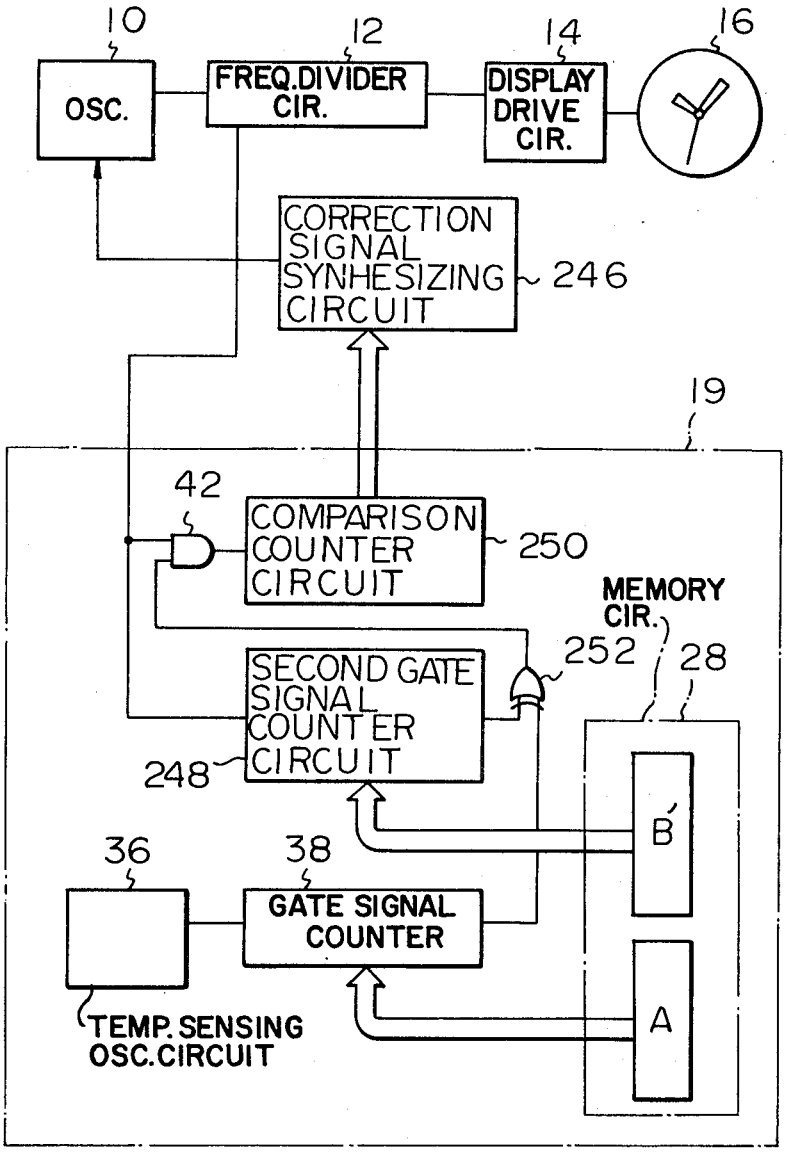
FIG. 18 and FIG. 19 are block diagrams illustrating two other embodiments of electronic timepieces according to the present invention.

The embodiments of the present invention described hereinabove, with reference to FIG. 3 to FIG. 17, are based on the configuration of the embodiment of FIG. 1, in which numeric conversion means and offset adjustment means are implemented using the same counter circuit. However various other possible configurations are also possible, and two examples of such configurations will be briefly described. FIG. 18 is a block diagram showing the basic configuration of an electronic timepiece embodiment. This differs from that of FIG. 3 (although both are essentially based on FIG. 1) in the following respects. The method of conversion of the temperature data value T into a quadratic function, performed by correction signal synthesizing circuit 246, has been simplified, and a second gate signal counter circuit 248 has been added, to perform counting of the output signal from frequency divider circuit 12 in accordance with the set value B in memory circuit 28 and to thereby produce a reference gate signal. In addition, an exclusive-OR gate 252 has been added, which generates the exclusive-OR logic sum of the gate signal from gate signal counter circuit 38 (which is identical to that of the embodiment of FIG. 3) and the reference gate signal produced as described above. This exclusive-OR logic sum signal is input to gate circuit 42. Since it is not necessary to perform presetting of comparison counter circuit 92 in this case, the circuit configuration can be simplified. Temperature measurement operations performed by this embodiment provide a value of temperature data value T given by the following equation:

$$T = A \times \tau \times fc - B'$$

In this case, it is not necessary for the correction signal synthesizing circuit 246 to produce the value $(T-128)^2$, in performing quadratic function conversion, and it is only necessary for this circuit to generate the value $T^2$, so that correction signal synthesizing circuit 246 can be simplified. On the other hand, it is necessary to use a larger value for the set value B than in the embodiment of FIG. 3. Thus, it is necessary to enlarge the second gate signal counter circuit 248 by a corresponding amount.

Figure 19:
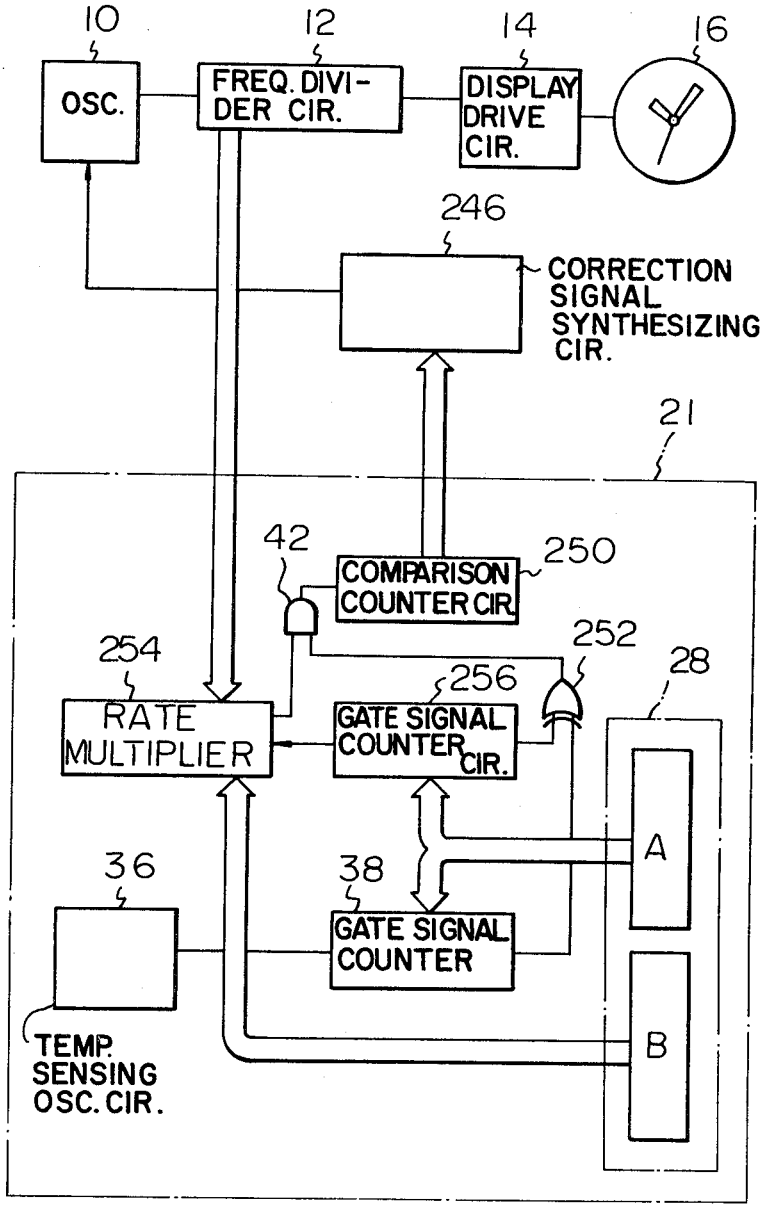

FIG. 19 shows the basic configuration of a third embodiment of an electronic timepiece according to the present invention. The differences between this and the embodiment of FIG. 18 are as follows. Firstly, in the embodiment of FIG. 19, the input signal to a gate signal counter circuit 256 is generated by a rate multiplier 254, which receives as inputs a group of signals from frequency divider circuit 12 and signals representing numeric value B from memory circuit 28. In addition, since gate signal counter circuit 256 produces a reference gate signal in accordance with the set value A, the gate signal counter circuits 38 and 256 can have an identical configuration. If the number of digits of rate multiplier 254 is designated as q, then B pulses will be selected from a rain of $2^q$ pulses by that circuit. Thus, this operation effectively performs frequency division by a factor $B/2^q$. With this configuration for the temperature measurement circuit (designated by numeral 21 in this embodiment), either signal fc from frequency divider circuit 12 is used as the clock signal input to gate circuit 42, without change, or the output signal produced by rate multiplier circuit 254 can be used as this clock signal (as in the example of FIG. 19), i.e. the signal resulting from division by $B/2^q$. The temperature measurement operation will differ, depending upon which of these methods is used to provide the clock signal input to gate 42, as will now be briefly described. The duration of the gate signal which is produced by exclusive-OR gate 252 is given as follows:

$$t = A \times (\tau - 2^q/B \times fc)$$

If numeric conversion is carried out using the signal of frequency fc as a clock signal, then the temperature data value T' which will result in this case, and the temperature data value T which results when numeric conversion is carried out using the signal of frequency $fc \times B/2^q$ as the clock signal, are given as follows:

$$T = A \times (\tau \times fc - 2^q/B)$$

$$T' = A \times (\tau \times fc \times B/2^q - 1)$$

In the former case, i.e. when the value T is obtained, the offset adjustment and slope adjustment are completely independent of one another. However in the case of the embodiment of FIG. 3, a change in the set value A, to perform adjustment of the characteristic slope, will make it necessary to change the value of B also. In the latter case, in which a temperature data value T' is obtained, the effects of manufacturing deviations on the value of $\tau$ will only affect the absolute value, so that if the rate of variation of $\tau$ with respect to temperature is constant, over different manufactured IC chips, it will be unnecessary to perform external setting of the value A. It is therefore possible in this case to fix the value of A using a mask ROM, for example.

As described hereinabove, a circuit for a temperature-compensated electronic timepiece in accordance with the present invention enables correction for variations (due to manufacturing deviations) in the abosolute value and the rate of change with respect to temperature of a temperature data signal produced from a temperature sensing oscillator circuit, with this correction being performed using a simple digital circuit configuration. Thus, such a circuit can readily be implemented as an integral portion of a monolithic MOS integrated circuit. In addition, adjustment values can be calculated precisely. Furthermore, since these adjustment values can be set using simple digital circuitry, fully automatic setting of these values is possible. Furthermore, with a temperature-compensated electronic timepiece in accordance with the present invention, temperature measurement can be performed to a high degree of precision, by using a temperature measurement circuit having the configuration described hereinabove, and the current consumed in temperature measurement operations can be made extremely low, for example of the order of an average current of less than 0.02 $\mu$A. By combining such a temperature measurement circuit with a correction signal synthesizing circuit as described for the preferred embodiments, it becomes possible to manufacture a small and thin electronic timepiece having a very high degree of timekeeping accuracy, e.g. of less than 10 seconds of timekeeping error per year, and since the present invention is particularly suited to modern automated manufacture and timekeeping rate measurement and adjustment techniques, it makes possible the mass production at an economical cost of electronic timepieces having a level of timekeeping accuracy that has hitherto been practicable for only relatively expensive timepieces.

Although the present invention has been described hereinabove with reference to specific embodiments, it should be noted that various changes and modifications to these embodiments may be envisaged, which fall within the scope claimed for the present invention. All matter contained in the above specification and in the attached drawings should therefore be interpreted in a descriptive, and not in a limiting sense. The scope claimed for the present invention is defined by the appended claims.

What is claimed is:

1. An electronic timepiece powered by a battery, having unit time signal generating circuit means for generating a unit time signal, said unit time signal generating circuit means comprising a quartz crystal oscillator circuit for producing a timebase signal, said quartz crystal oscillator circuit displaying a quadratic relationship between ambient operating temperature and frequency of oscillation, and frequency divider circuit means coupled to receive said timebase signal for performing frequency division thereof to thereby generate a plurality of timing signals of different frequencies including said unit time signal, said electronic timepiece further comprising display drive circuit means coupled to receive said unit time signal, a display device driven by said display drive circuit means to display time information in accordance with said unit time signal, and temperature compensation means for compensating changes in the period of said unit time signal resulting from the effects of changes in the ambient operating temperature upon the oscillation frequency of said quartz crystal oscillator circuit, said temperature compensation circuit means comprising:

temperature measuring circuit means for sensing the ambient temperature of said quartz crystal oscillator circuit to produce temperature information indicative thereof, as a digital value, and;

frequency compensation means for producing the square of said digital value representing temperature information from said temperature measurement circuit means and for applying a value resulting from said squaring operation to control the operation of said unit time signal generating circuit means such as to compensate the period thereof for the effects of ambient temperature variations;

said temperature measurement circuit means including temperature sensing circuit means for producing a temperature sensing signal whose repetition frequency varies in accordance with ambient temperature, slope adjustment circuit means for dividing the frequency of said temperature sensing signal by a factor which is determined in accordance with a preset value, numeric conversion means for converting an output signal produced by said slope adjustment circuit means to temperature information in digital form, and offset adjustment circuit means for effecting offset compensation of said digital temperature information from said numeric conversion circuit means.

2. An electronic timepiece according to claim 1, in which each of said slope adjustment circuit means and offset adjustment circuit means comprise set value memory circuit means which are externally settable for storing data representing numeric values.

3. An electronic timepiece according to claim 2, and further comprising control circuit means for initiating temperature measurement operations to generate said temperature data value on a periodic repetitive basis.

4. An electronic timepiece according to claim 3, and further comprising gate signal counter circuit means coupled to receive said temperature sensing signal for counting a predetermined number of pulses thereof upon each of said temperature measurement operations, to thereby produce a gate signal of duration determined by the period of said temperature sensing signal, and in which said numeric value conversion means comprise comparison gate circuit means coupled to receive one of said timing signals from said frequency divider circuit means and comparison counter circuit means, said comparison gate circuit means being controlled by said gate signal from said gate signal counter circuit means for transferring said timing signal to an input of said comparison counter circuit means to be counted thereby, with the count contents of said comparison counter circuit means at the termination of said counting constituting said temperature data value.

5. An electronic timepiece according to claim 4, in which said slope adjustment circuit means comprise said gate signal counter circuit means, with said gate signal counter circuit means comprising a presettable counter circuit which is preset to a numeric value stored in said set value memory circuit means at the start of each of said temperature measurement operations, with said numeric value determining the maximum number of pulses of said temperature sensing signal to be counted by said gate signal counter circuit means during said temperature measurement operation.

6. An electronic timepiece according to claim 4, in which said numeric conversion means also serves as said offset adjustment circuit means.

7. An electronic timepiece according to claim 6, in which said comparison counter circuit means comprise a presettable counter circuit, and further comprising circuit means for presetting a numeric value stored in said set value memory circuit means into said presettable counter at the start of each of said temperature measurement operations as an initial count value.

8. An electronic timepiece according to claim 1, in which said temperature sensing circuit means comprise a temperature sensing voltage stabilizer circuit for producing an output voltage which is substantially constant with respect to changes in the voltage of said battery and which varies in accordance with changes in ambient operating temperature, and an oscillator circuit controlled by said output voltage from said temperature sensing voltage stabilizer circuit for producing said temperature sensing signal, with the frequency of said temperature sensing signal being determined in accordance with the level of said output voltage from said temperature sensing voltage stabilizer circuit.

9. An electronic timepiece according to claim 8, in which said temperature sensing voltage stabilizer circuit and said oscillator circuit of said temperature sensing circuit means each comprise a set of field effect transistors and resistor elements formed integrally within a single integrated circuit chip together with components of said quartz crystal oscillator circuit.

10. An electronic timepiece according to claim 3, and further comprising temperature register circuit means for storing said temperature data value in the intervals between said temperature measurement operations.

11. An electronic timepiece according to claim 1, in which said frequency correction circuit means comprise a correction signal synthesizing circuit responsive to said temperature data from said numeric data conversion means for generating a correction signal, said correction signal alternating between first and second logic level potentials with a duty ratio which varies as a quadratic function of temperature, and further comprising a capacitor and electronic switch means responsive to said correction signal for selectively connecting and disconnecting said capacitor from said quartz crystal oscillator circuit for thereby correcting the average frequency of oscillation thereof.

* * * * *